US011761271B2

(12) United States Patent
Leicht et al.

(10) Patent No.: US 11,761,271 B2
(45) Date of Patent: Sep. 19, 2023

(54) LATERAL ISOLATOR

(71) Applicant: LORD Corporation, Cary, NC (US)

(72) Inventors: Zackary Leicht, Cranesville, PA (US); Adam Keithly, Conroe, TX (US); Keith R. Ptak, Erie, PA (US); Timothy O'Connor, Erie, PA (US)

(73) Assignee: LORD Corporation, Cary, NC (US)

( * ) Notice: Subject to any disclaimer, the term of this patent is extended or adjusted under 35 U.S.C. 154(b) by 0 days.

(21) Appl. No.: 17/598,966

(22) PCT Filed: Mar. 4, 2020

(86) PCT No.: PCT/US2020/020901
§ 371 (c)(1),
(2) Date: Sep. 28, 2021

(87) PCT Pub. No.: WO2020/205138
PCT Pub. Date: Oct. 8, 2020

(65) Prior Publication Data

US 2022/0195815 A1 Jun. 23, 2022

Related U.S. Application Data

(60) Provisional application No. 62/827,369, filed on Apr. 1, 2019.

(51) Int. Cl.
*E21B 17/10* (2006.01)
*E21B 17/07* (2006.01)

(52) U.S. Cl.
CPC ..... *E21B 17/073* (2013.01); *E21B 17/1042* (2013.01)

(58) Field of Classification Search
CPC ..... E21B 17/1042; E21B 17/10; E21B 17/04; E21B 17/041
See application file for complete search history.

(56) References Cited

U.S. PATENT DOCUMENTS 2,572,307 A * 10/1951 Brown ..... E21B 17/1064 175/294
2,795,398 A 6/1957 Ragland
3,593,797 A * 7/1971 Lebourg ..... E21B 33/124 166/290

(Continued)

FOREIGN PATENT DOCUMENTS

WO WO 2017/004399 A1 1/2017
WO WO 2020/205138 A1 10/2020

OTHER PUBLICATIONS

International Search Report and Written Opinion PCT/US2020/020901 dated May 19, 2020.

*Primary Examiner* — Shane Bomar
(74) *Attorney, Agent, or Firm* — KDW FIRM PLLC

(57) ABSTRACT

A lateral isolator (200) has a tubular body with an upstream end and a downstream end. The lateral isolator (200) also includes an inner member (210) having a pivot ring (220) disposed within the tubular body. A first elastomeric package (236) is disposed between the tubular body and the inner member (210) longitudinally between the pivot ring (220) and the upstream end. A second elastomeric package (236) is disposed between the tubular body and the inner member (210) longitudinally between the pivot ring (220) and the downstream end.

20 Claims, 18 Drawing Sheets

(56) References Cited

U.S. PATENT DOCUMENTS

| | | | | |
|---|---|---|---|---|
| 3,606,392 | A * | 9/1971 | Garrett | F16L 55/04 175/321 |
| 3,714,831 | A | 2/1973 | Quichaud et al. | |
| 4,630,809 | A * | 12/1986 | Duckworth | E21B 47/017 267/141.1 |
| 4,823,125 | A * | 4/1989 | Rorden | E21B 34/06 340/854.6 |
| 9,334,698 | B2 * | 5/2016 | Hansen | F16F 1/40 |
| 9,869,135 | B1 * | 1/2018 | Martin | E21B 17/042 |
| 10,934,778 | B2 * | 3/2021 | Lu | E21B 17/046 |
| 2014/0370995 | A1 * | 12/2014 | Collins | F16D 3/845 464/138 |
| 2015/0218938 | A1 | 8/2015 | Weisbeck et al. | |
| 2015/0322739 | A1 | 11/2015 | Macdonald et al. | |
| 2016/0201413 | A1 | 7/2016 | White et al. | |
| 2017/0045090 | A1 * | 2/2017 | Kuhn | F16D 3/04 |
| 2018/0155992 | A1 * | 6/2018 | Brown | E21B 47/017 |
| 2020/0340308 | A1 * | 10/2020 | McCormick | E21B 17/02 |
| 2022/0145708 | A1 * | 5/2022 | Marr | E21B 17/10 |

* cited by examiner

| LATERAL SHOCK - PULSER MODULE | | | | |
|---|---|---|---|---|
| SETUP | AVERAGE SHOCK [G] | AVERAGE >30 G SHOCK / HR | AVERAGE >20 G SHOCK / HR | AVERAGE >10 G SHOCK / HR |
| AXIAL ISO WITHOUT FINS | 10.0 | 18.2 | 82.1 | 281.9 |
| AXIAL ISO, LATERAL, WITH FINS | 7.1 | 2.2 | 20.5 | 151.0 |
| SHOCK MITIGATED | 29.7% | 87.7% | 75.1% | 46.4% |

FIG. 23

| LATERAL SHOCK - GAMMA MODULE | | | | |
|---|---|---|---|---|
| SETUP | AVERAGE SHOCK [G] | AVERAGE >30 G SHOCK / HR | AVERAGE >20 G SHOCK / HR | AVERAGE >10 G SHOCK / HR |
| AXIAL ISO WITHOUT FINS | 15.0 | 84.9 | 179.4 | 422.8 |
| AXIAL ISO, LATERAL, WITH FINS | 10.3 | 20.4 | 76.8 | 295.7 |
| SHOCK MITIGATED | 31.4% | 75.9% | 57.2% | 30.1% |

FIG. 24

| LATERAL SHOCK - DIRECTIONAL MODULE *ONLY TWO NO LATERAL / NO FIN DATA POINTS* | | | | |
|---|---|---|---|---|
| SETUP | AVERAGE SHOCK [G] | AVERAGE >30 G SHOCK / HR | AVERAGE >20 G SHOCK / HR | AVERAGE >10 G SHOCK / HR |
| AXIAL ISO WITHOUT FINS | 9.5 | 2.9 | 30.4 | 294.1 |
| AXIAL ISO, LATERAL, WITH FINS | 8.6 | 2.3 | 25.4 | 237.8 |
| SHOCK MITIGATED | 9.9% | 21.0% | 16.2% | 19.1% |

FIG. 25

| Run | Setup | Isolator Serial Number | Location | Average Shock [G] | Shock Events >30 G |
|---|---|---|---|---|---|
| Group1_13 | Axial Iso without Fins | | Gamma Module | 28.25 | 6073 |
| Group1_15 | Axial Iso without Fins | | Gamma Module | 11.52 | 1226 |
| Group1_16 | Axial Iso without Fins | | Gamma Module | 10.88 | 1042 |
| Group2_10 | Axial Iso without Fins | | Gamma Module | 11.57 | 784 |
| Group2_11 | Axial Iso without Fins | | Gamma Module | 12.99 | 379 |
| Group2_15 | Axial Iso, Lateral, with Fins | | 4 Gamma Module | 7.73 | 157 |
| Group3_12 | Axial Iso, Lateral, with Fins | | 3 Gamma Module | 12.91 | 1077 |
| Group3_13 | Axial Iso, Lateral, with Fins | | 3 Gamma Module | 10.88 | 894 |
| Group3_14 | Axial Iso, Lateral, with Fins | | 3 Gamma Module | 10.5 | 744 |
| Group4_21 | Axial Iso, Lateral, with Fins | | 4 Gamma Module | 9.57 | 860 |
| Group1_13 | Axial Iso without Fins | | Pulser Module | 17.85 | 1327 |
| Group1_15 | Axial Iso without Fins | | Pulser Module | 7.37 | 89 |
| Group1_16 | Axial Iso without Fins | | Pulser Module | 7.05 | 99 |
| Group2_10 | Axial Iso without Fins | | Pulser Module | 8.71 | 178 |
| Group2_11 | Axial Iso without Fins | | Pulser Module | 9.26 | 70 |
| Group2_15 | Axial Iso, Lateral, with Fins | | 4 Pulser Module | 6.13 | 47 |
| Group3_12 | Axial Iso, Lateral, with Fins | | 3 Pulser Module | 8.73 | 123 |
| Group3_13 | Axial Iso, Lateral, with Fins | | 3 Pulser Module | 7.32 | 93 |
| Group3_14 | Axial Iso, Lateral, with Fins | | 3 Pulser Module | 7.14 | 48 |
| Group4_21 | Axial Iso, Lateral, with Fins | | 4 Pulser Module | 5.99 | 71 |
| Group2_10 | Axial Iso without Fins | | Directional Module | 9.34 | 92 |
| Group2_11 | Axial Iso without Fins | | Directional Module | 9.74 | 46 |
| Group2_15 | Axial Iso, Lateral, with Fins | | 4 Directional Module | 7.22 | 43 |
| Group3_12 | Axial Iso, Lateral, with Fins | | 3 Directional Module | 10.75 | 120 |
| Group3_13 | Axial Iso, Lateral, with Fins | | 3 Directional Module | 8.69 | 89 |
| Group3_14 | Axial Iso, Lateral, with Fins | | 3 Directional Module | 7.83 | 37 |
| Group4_21 | Axial Iso, Lateral, with Fins | | 4 Directional Module | 8.47 | 160 |

TO FIG. 26B

FIG. 26A

FROM FIG. 26A

| Shock Events >20 G | Shock Events >10 G | Run Duration [Hrs] | >30 G Shock / Hr | >20 G Shock / Hr | >10 G Shock / Hr |
|---|---|---|---|---|---|
| 9007 | 10680 | 17.81 | 341.0 | 505.7 | 599.7 |
| 6241 | 22874 | 62.65 | 19.6 | 99.6 | 365.1 |
| 4964 | 18560 | 54.25 | 19.2 | 91.5 | 342.1 |
| 2723 | 10830 | 30.78 | 25.5 | 88.5 | 351.9 |
| 2184 | 8908 | 19.57 | 19.4 | 111.6 | 455.2 |
| 1092 | 7960 | 39.18 | 4.0 | 27.9 | 203.2 |
| 4177 | 12205 | 30.63 | 35.2 | 136.4 | 398.5 |
| 2674 | 6723 | 22.82 | 39.2 | 117.2 | 294.6 |
| 3112 | 18109 | 55.63 | 13.4 | 55.9 | 325.5 |
| 3833 | 21004 | 81.85 | 10.5 | 46.8 | 256.6 |
| 5289 | 9698 | 17.37 | 76.4 | 304.5 | 558.3 |
| 983 | 10897 | 62.65 | 1.4 | 15.7 | 173.9 |
| 962 | 8818 | 54.25 | 1.8 | 17.7 | 162.5 |
| 952 | 5174 | 22.47 | 7.9 | 42.4 | 230.3 |
| 594 | 5587 | 19.64 | 3.6 | 30.2 | 284.5 |
| 414 | 4296 | 36.22 | 1.3 | 11.4 | 118.6 |
| 1156 | 7376 | 30.63 | 4.0 | 37.7 | 240.8 |
| 810 | 4151 | 22.38 | 4.2 | 36.2 | 185.5 |
| 526 | 7190 | 55.63 | 0.9 | 9.5 | 129.2 |
| 615 | 6633 | 81.85 | 0.9 | 7.5 | 81.0 |
| 905 | 6888 | 26.03 | 3.5 | 34.8 | 264.6 |
| 508 | 6335 | 19.58 | 2.3 | 25.9 | 323.5 |
| 371 | 5978 | 37.01 | 1.2 | 10.0 | 161.5 |
| 1485 | 11473 | 30.59 | 3.9 | 48.5 | 375.1 |
| 937 | 6374 | 22.78 | 3.9 | 41.1 | 279.8 |
| 502 | 9283 | 55.57 | 0.7 | 9.0 | 167.1 |
| 1505 | 16812 | 81.7 | 2.0 | 18.4 | 205.8 |

FIG. 26B

LATERAL ISOLATOR

CROSS-REFERENCE TO RELATED APPLICATION

This application claims priority to U.S. Provisional Patent Application No. 62/827,369, filed on 1 Apr. 2019 by Zackary Leicht, et al., and titled "LATERAL ISOLATOR", the disclosure of which is incorporated by reference in its entirety.

FIELD OF INVENTION

The subject matter disclosed herein relates to the design and operation of vibration isolation systems for environments subject to shocks and vibrations, such as downhole operations.

BACKGROUND

In some hydrocarbon recovery systems and/or downhole systems, electronics and/or other sensitive hardware (e.g., sometimes referred to as a tool string) may be included in a drill string. In some cases, a drill string may be exposed to both repetitive vibrations including a relatively consistent frequency and to vibratory shocks that may not be repetitive. Each of the repetitive vibrations and shock vibrations may damage and/or otherwise interfere with the operation of the electronics, such as, but not limited to, measurement while drilling (MWD) devices and/or logging while drilling (LWD) devices, and/or any other vibration-sensitive device of a drill string. Some electronic devices are packaged in vibration resistant housings that are not capable of protecting the electronic devices against both the repetitive and shock vibrations. Active vibration isolation systems can isolate the electronics from harmful vibration but at added expense.

SUMMARY

According to an example embodiment, a lateral isolator is provided, the lateral isolator comprising: a housing comprising an upstream end and a downstream end; an inner member comprising a pivot ring disposed within the housing; a first elastomeric package disposed between the housing and the inner member, at a position longitudinally between the pivot ring and the upstream end; and a second elastomeric package disposed between the housing and the inner member, at a position longitudinally between the pivot ring and the downstream end.

In some embodiments, the lateral isolator comprises a centralizer sub attached at the upstream end of the housing, the centralizer sub comprising a plurality of compliant fins attached to an outer surface of the centralizer sub and being spaced radially apart from each other about a longitudinal central axis of the lateral isolator.

In some embodiments of the lateral isolator, the first elastomeric package and the second elastomeric package are configured to collectively respond to a first input force frequency range, wherein the plurality of compliant fins are configured to collectively respond to a second input force frequency range, and wherein the second input force frequency range is different than first input force frequency range.

In some embodiments of the lateral isolator, each of the compliant fins is configured such that, when a first compliant fin of the compliant fins is radially compressed, an area of an outer face of the compliant fin, which is in contact with a structure in which the lateral isolator is positioned increases to provide a nonlinear stiffening force to the lateral isolator.

In some embodiments of the lateral isolator, when the lateral isolator is disposed in a wellbore, the lateral isolator maintains a lateral isolator pressure column through a central bore of the lateral isolator that is pressure independent from a mud flow pressure column between an exterior of the lateral isolator and the wellbore.

In some embodiments of the lateral isolator, when an input force is laterally applied to the inner member in a first direction, the lateral isolator is configured such that a first reaction force opposing the input force is reacted through the first elastomeric package, a second reaction force for opposing the first reaction force is reacted through the second elastomeric package, and a fin force opposing the input force is reacted through at least one of the compliant fins.

In some embodiments of the lateral isolator, the first and second elastomeric packages are pre-compressed in an axial direction.

In some embodiments of the lateral isolator, the first and second elastomeric packages are configured to bulge and bulk load.

In some embodiments of the lateral isolator, the bulk loading is in response to a cocking movement of the inner member about the pivot ring, and wherein the bulk loading provides a soft snub rather than a direct contact.

In some embodiments of the lateral isolator, the pivot ring comprises a polygonal profile complimentary to a polygonal profile provided within the housing, and wherein the polygonal profiles of the pivot ring and the housing are configured to provide torsional locking between the inner member and the housing.

In some embodiments of the lateral isolator, the elastomeric packages are configured such that the inner member is rotatably displaceable relative to the body.

BRIEF DESCRIPTION OF THE DRAWINGS

For a more complete understanding of the present disclosure and the advantages thereof, reference is now made to the following brief description, taken in connection with the accompanying drawings and detailed description.

FIG. 23 is a chart of run data obtained from a pulser module of the tool string of FIG. 21.

FIG. 24 is a chart of run data obtained from a gamma module of the tool string of FIG. 21.

FIG. 25 is a chart of run data obtained from a directional module of the tool string of FIG. 21.

FIGS. 26A and 26B are charts of detailed shock values, counts, and reductions by run of the tool string of FIG. 21.

DETAILED DESCRIPTION

Figure 1:
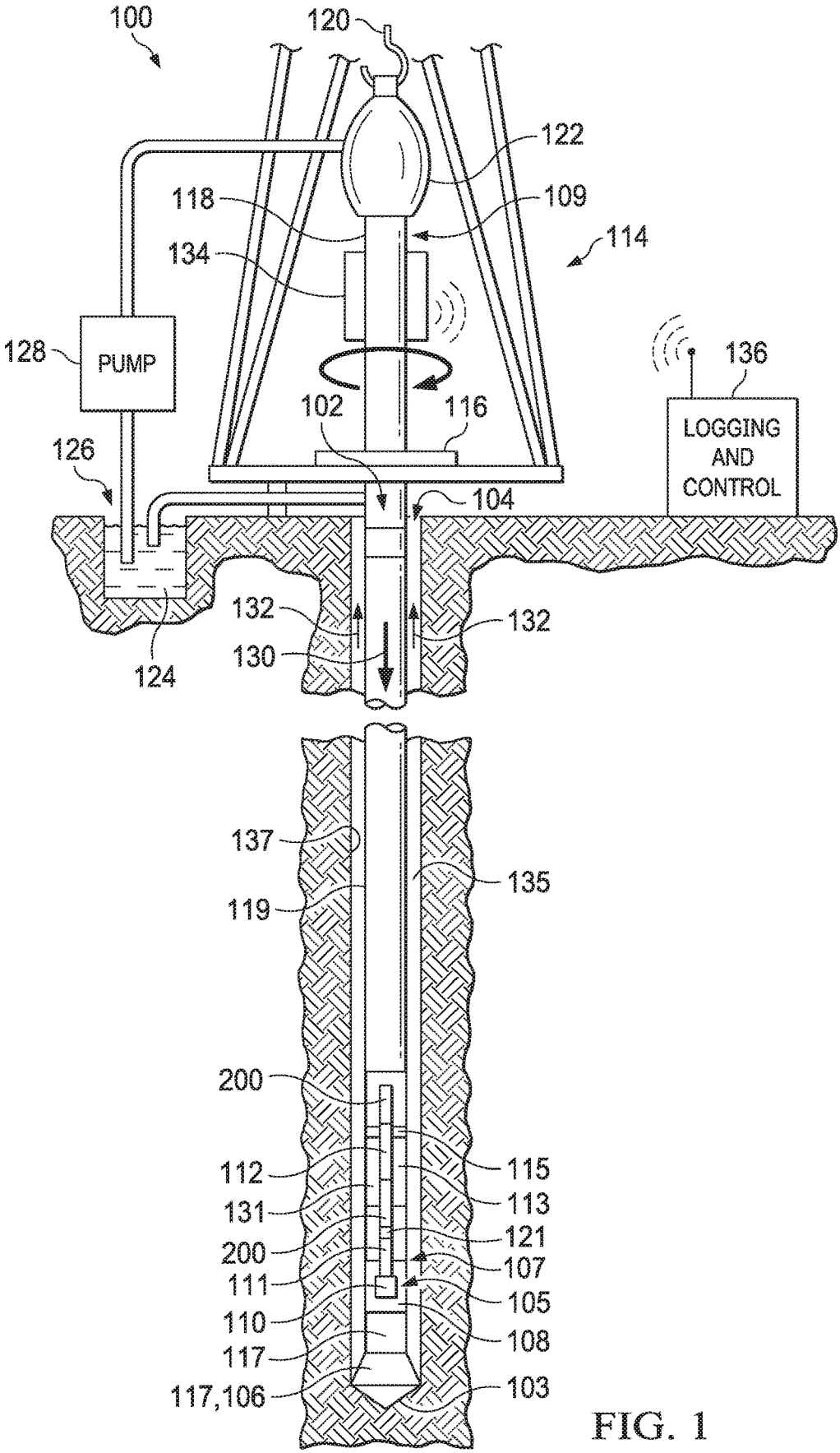
FIG. 1 is a side view of an example hydrocarbon recovery system comprising an example embodiment of a drill string with lateral isolators according to a first example embodiment disclosed herein.
Figure 2:
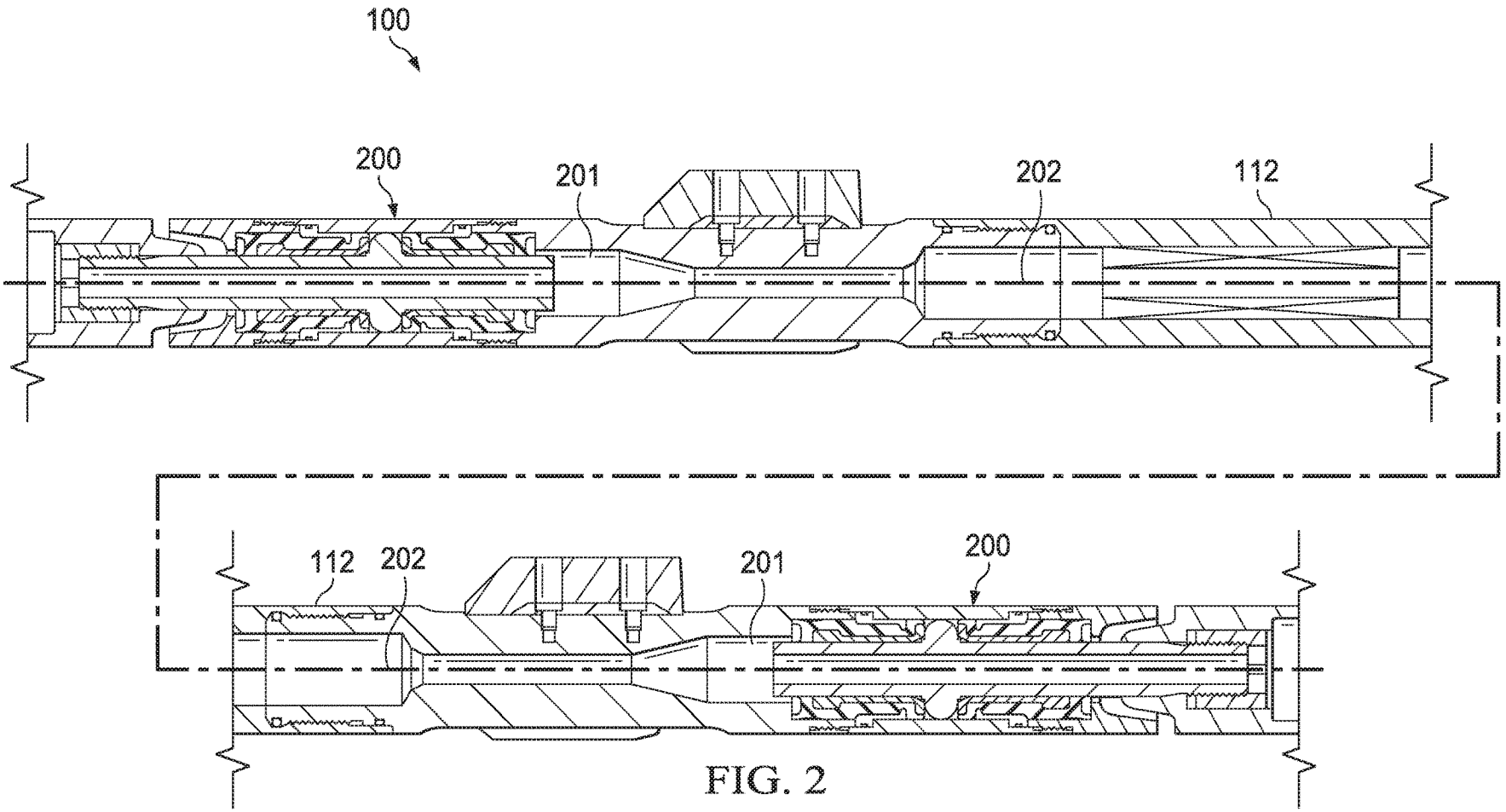
FIG. 2 is a cross-sectional view of a portion of the hydrocarbon recovery system of FIG. 1, showing the lateral isolators in greater detail.
Figure 3:
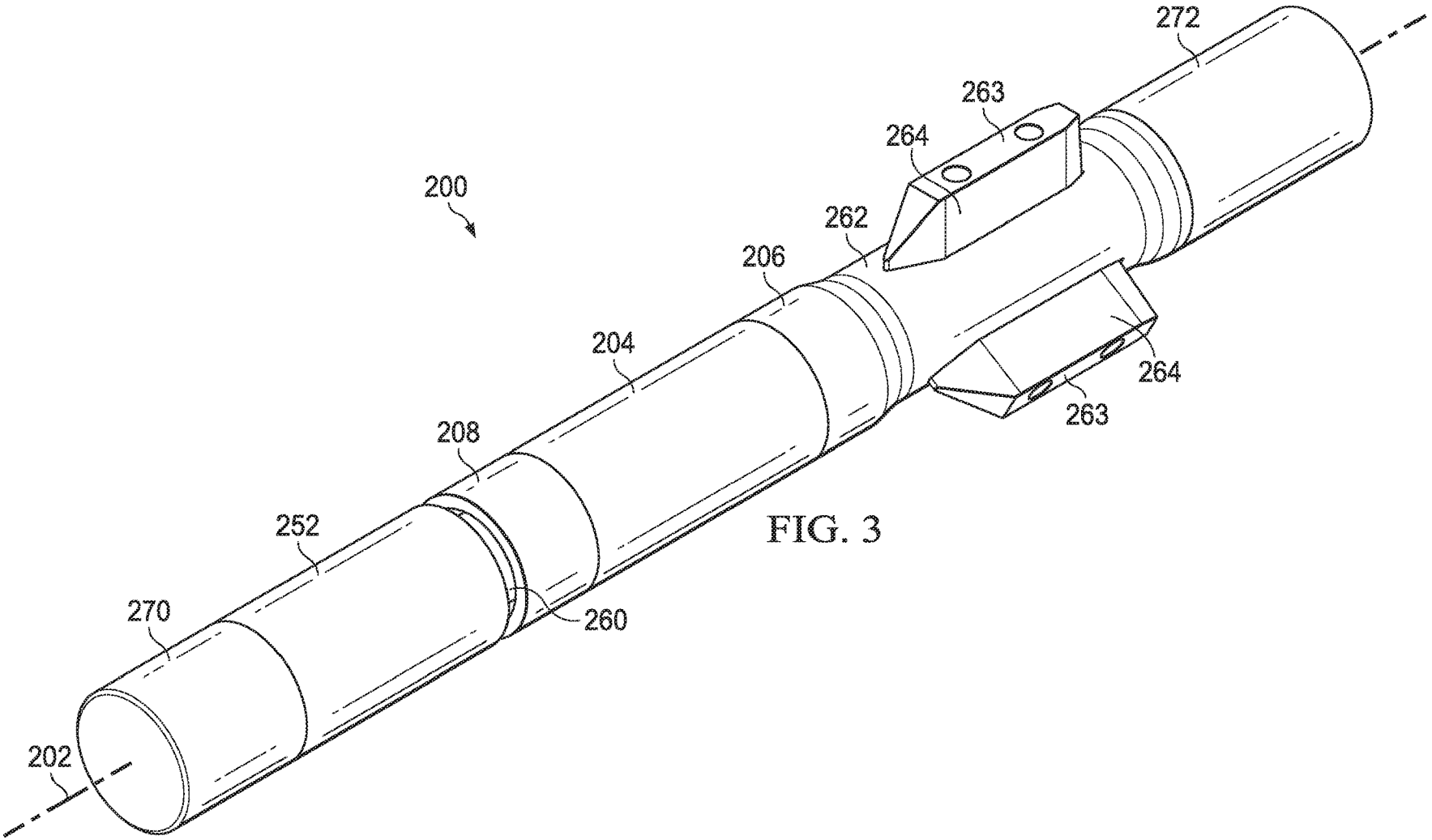
FIG. 3 is an oblique view of one of the lateral isolators of FIG. 1.

Referring now to FIG. 1, an example embodiment of a hydrocarbon recovery system (HRS), generally designated 100, is shown. Although the HRS 100 is shown as being onshore (e.g., on land), in alternative embodiments, the HRS 100 can be installed in an offshore location (e.g., at sea). The HRS 100 generally includes a drill string, generally designated 102 suspended within a borehole, generally designated 104. The borehole 104 extends substantially vertically away from the earth's surface over a vertical wellbore portion or, in some embodiments, deviates at any suitable angle from the earth's surface over a deviated or horizontal wellbore portion. In alternative operating environments, portions or substantially all of a borehole 104 may be vertical, deviated, horizontal, curved, and/or combinations thereof.

The drill string 102 includes a drill bit 106 at a lower end 103 of the drill string 102 and a universal bottom hole orienting (UBHO) sub 108 connected above the drill bit 106. The UBHO sub 108 includes a mule shoe 110 configured to connect with a stinger or pulser helix 111 on a top side, generally designated 105, of the mule shoe 110. The HRS 100 further includes an electronics casing 113 incorporated within the drill string 102 above the UBHO sub 108, for example, connected to a top side, generally designated 107, of the UBHO sub 108. The electronics casing 113 may at least partially house the stinger or pulser helix 111, a lateral isolator 200 connected above the stinger or pulser helix 111, an isolated mass 112 connected above the lateral isolator 200, a lateral isolator 200 connected above the isolated mass 112, and/or centralizers 115. The isolated mass 112 can include electronic components. The HRS 100 includes a platform and derrick assembly, generally designated 114, positioned over the borehole 104 at the surface. The platform and derrick assembly 114 includes a rotary table 116, which engages a kelly 118 at an upper end, generally designated 109, of the drill string 102 to impart rotation to the drill string 102. The drill string 102 is suspended from a hook 120 that is attached to a traveling block. The drill string 102 is positioned through the kelly 118 and the rotary swivel 122 which permits rotation of the drill string 102 relative to the hook 120. Additionally, or alternatively, a top drive system may be used to impart rotation to the drill string 102.

The HRS 100 further includes drilling fluid 124 which may include a water-based mud, an oil-based mud, a gaseous drilling fluid, water, brine, gas, and/or any other suitable fluid for maintaining bore pressure and/or removing cuttings from the area surrounding the drill bit 106. Some volume of drilling fluid 124 may be stored in a pit, generally designated 126, and a pump 128 may deliver the drilling fluid 124 to the interior of the drill string 102 via a port in the rotary swivel 122, causing the drilling fluid 124 to flow downwardly through the drill string 102, as indicated by directional arrow 130. The drilling fluid 124 may pass through an annular space 131 between the electronics casing 113 and each of the pulser helix 111, the lateral isolator 200, and/or the isolated mass 112 prior to exiting the UBHO sub 108. After exiting the UBHO sub 108, the drilling fluid 124 may exit the drill string 102 via ports in the drill bit 106 and be circulated upwardly through an annulus region 135 between the outside of the drill string 102 and a wall 137 of the borehole 104, as indicated by directional arrows 132. The drilling fluid 124 may lubricate the drill bit 106, carry cuttings from the within the borehole 104 up to the surface as the drilling fluid 124 is returned to the pit 126 for recirculation and/or reuse, and/or create a mudcake layer (e.g., filter cake) on the walls 137 of the borehole 104.

The drill bit 106 may generate vibratory forces and/or shock forces in response to encountering hard formations during the drilling operation. Although the drill bit 106 itself can be considered an excitation source 117 that provides some vibratory excitation to the drill string 102, the HRS 100 may further include an excitation source 117 such as an axial excitation tool 119 and/or any other vibratory device configured to agitate, vibrate, shake, and/or otherwise change a position of an end of the drill string 102 and/or any other component of the drill string 102 relative to the wall 137 of the borehole 104. In some cases, operation of such an axial excitation tool 119 may generate oscillatory movement of selected portions of the drill string 102, so that the drill string 102 is less likely to become hung or otherwise prevented from advancing into and/or out of the borehole 104. In some embodiments, low frequency oscillations of one or more excitation sources 117 may have values of about 5 Hz to about 100 Hz, inclusive. The term excitation source 117 is intended to refer to any source of the vibratory or shock forces described herein, including, but not limited to, a drill bit 106, an axial excitation tool 119 that is purpose built to generate such forces, and/or combinations thereof. It will further be appreciated that drill bit whirl and stick slip are also primary sources of lateral shock and vibration and, hence, can also be primary sources of such lateral shock and vibration inputs.

In the embodiment of FIG. 1, the HRS 100 further includes a communications relay 134 and a logging and control processor 136. The communications relay 134 may receive information and/or data from sensors, transmitters, receivers, and/or other communicating devices that may form a portion of the isolated mass 112. In some embodiments, the information is received by the communications relay 134 via a wired communication path through the drill string 102. In other embodiments, the information is received by the communications relay 134 via a wireless communication path. In some embodiments, the communications relay 134 transmits the received information and/or data to the logging and control processor 136. Additionally, or alternatively, the communications relay 134 can receive data and/or information from the logging and control processor 136. In some embodiments, upon receiving the data and/or information, the communications relay 134 forwards the data and/or information to the appropriate sensor(s), transmitter(s), receiver(s), and/or other communicating devices. The isolated mass 112 may include measuring while drilling (MWD) devices and/or logging while drilling (LWD) devices and the isolated mass 112 may include multiple tools or subs and/or a single tool and/or sub. In the embodiment of FIG. 1, the drill string 102 includes a plurality of tubing sections; that is, the drill string 102 is a jointed or segmented string. Alternative embodiments of drill string 102 can include any other suitable conveyance type, for example, coiled tubing, wireline, and/or wired drill pipe. The HRSs 100 that implement at least one embodiment of a lateral isolator 200 and/or lateral isolator 300 (see, e.g., FIGS. 13 to 16) disclosed herein may be referred to as downhole systems for isolating a component, (e.g., for isolating lateral and/or axial forces to an isolated mass 112). Further, while the lateral isolator 200 and/or lateral isolator 300 disclosed herein may provide some nominal amount of axial isolation, most uses of such lateral isolators 200, 300 will be accompanied by use of an axial isolator 121 disposed in series with the lateral isolators 200, 300 along a drill string, such as drill string 102, and/or along a tool string that comprises a portion of (e.g., is installed within and/or in-line with) a drill string, such as drill string 102.

Referring generally to FIGS. 2 through 10, the lateral isolator 200 generally defines a longitudinally-extending flowbore 201 and has a central axis 202 with respect to which many of the components of the lateral isolator 200 are substantially coaxially aligned, when in a non-deflected state. The lateral isolator 200 generally includes a tubular housing 204, a centralizer sub 206 connected to the housing 204 at a first end of the housing 204, and a housing cap 208 connected to the housing 204 at a second end of the housing 204. The housing 204 is configured to receive portions of an inner member, generally designated 210, and two tubeform assemblies, generally designated 212. In the example embodiment shown, the housing 204 comprises an interior circumferential shoulder 214. A first of the two tubeform assemblies 212 can be, or is, retained longitudinally between the shoulder 214 and the housing cap 208. A second of the two tubeform assemblies 212 can be, or is, retained longitudinally between the shoulder 214 and the centralizer sub 206.

Figure 4:
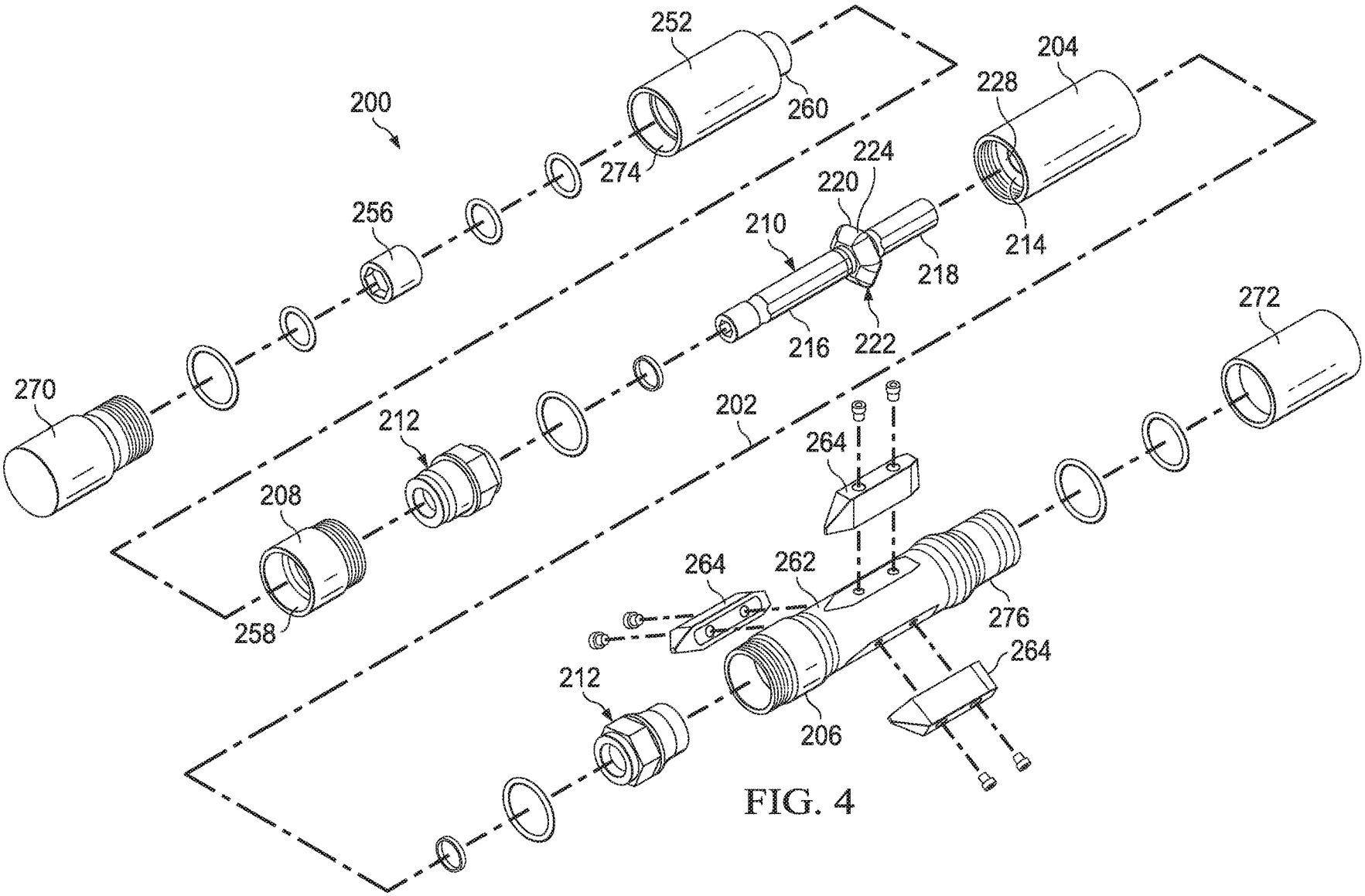
FIG. 4 is an oblique exploded view of the lateral isolator of FIG. 3.
Figure 5:
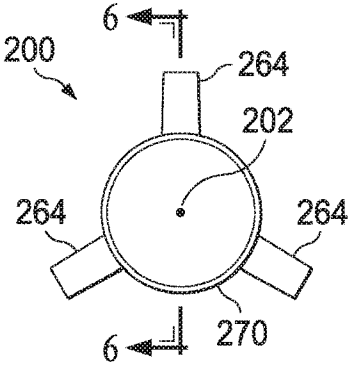
FIG. 5 is a top view of the lateral isolator of FIG. 3.
Figure 6:
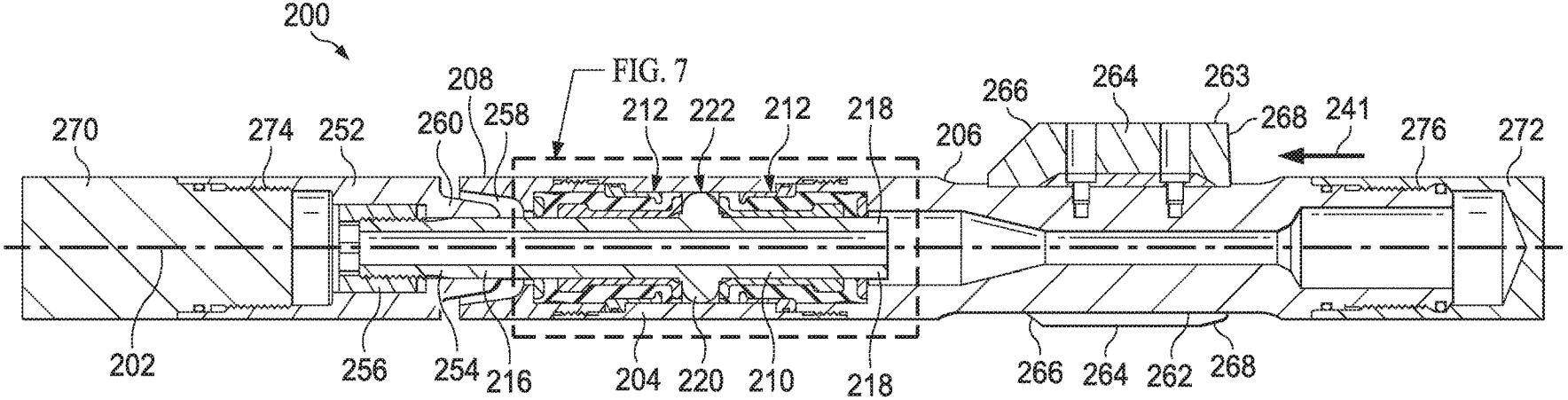
FIG. 6 is a cross-sectional side view of the lateral isolator of FIG. 3, taken along cutting line 6-6 of FIG. 5.
Figure 7:
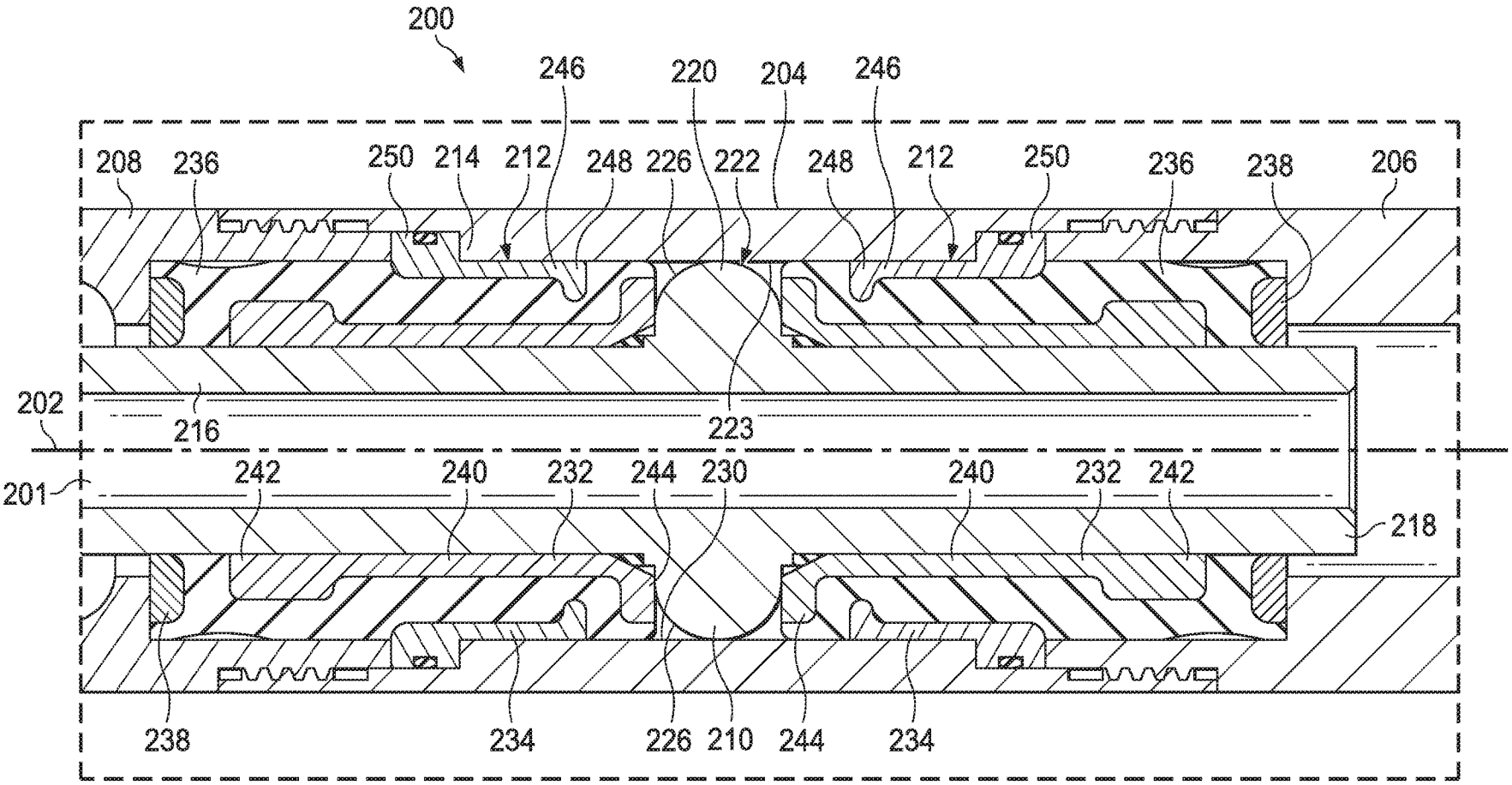
FIG. 7 is a detailed cross-sectional view of the lateral isolator of FIG. 6.

Referring primarily to FIGS. 4, 6, and 7, the inner member 210 is generally a tubular structure having a first tubular portion 216, a second tubular portion 218, and a tubular pivot ring 220, which is connected between the first tubular portion 216 and the second tubular portion 218. The first tubular portion 216 comprises an outer diameter that is substantially similar to an outer diameter of the second tubular portion 218. The first tubular portion 216 is longer than the second tubular portion 218. The pivot ring 220 comprises a generally polygonal exterior profile 222, which is shaped, in the example embodiment shown, as a hexagonal profile having six sides 224 when viewed from above or below (e.g., along the central axis 202). The sides 224 each comprise curved outer surfaces 226 that are configured to contact an interior shoulder surface 228 of the shoulder 214. Further, the interior shoulder surface 228 comprises a shoulder profile 230 that is complementary to the polygonal exterior profile 222 of the inner member 210. Accordingly, when the pivot ring 220 is received within the housing 204 and, more specifically, longitudinally within the shoulder 214 and in contact with the interior shoulder surface 228, the inner member 210 is prevented from rotating angularly about the central axis 202 relative to the housing 204. While the polygonal exterior profile 222 and the interior shoulder surface 228 each have generally hexagonal profiles, in alternative embodiments, the interior shoulder surface 228 and the polygonal exterior profile 222 can comprise any other suitable complementary shapes that, when nested together, similarly prevent relative angular rotation between the inner member 210 and the housing 204 about the central axis 202, while allowing the relative movements of the inner member 210 relative to the housing 204 described elsewhere herein. It will be appreciated that the polygonal exterior profile 222 can be provided, in some embodiments, as having more or fewer than six sides, such as, but not limited to, pentagonal or octagonal shapes.

Figure 8:
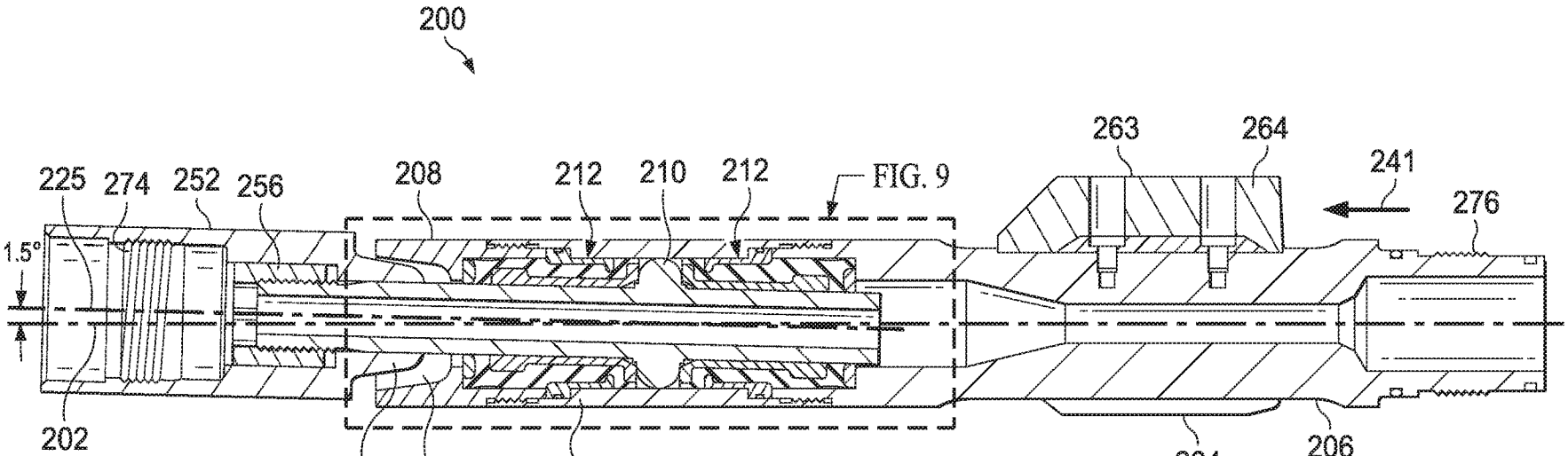
FIG. 8 is a cross-sectional view of the lateral isolator of FIG. 6 in a perturbed state.
Figure 9:
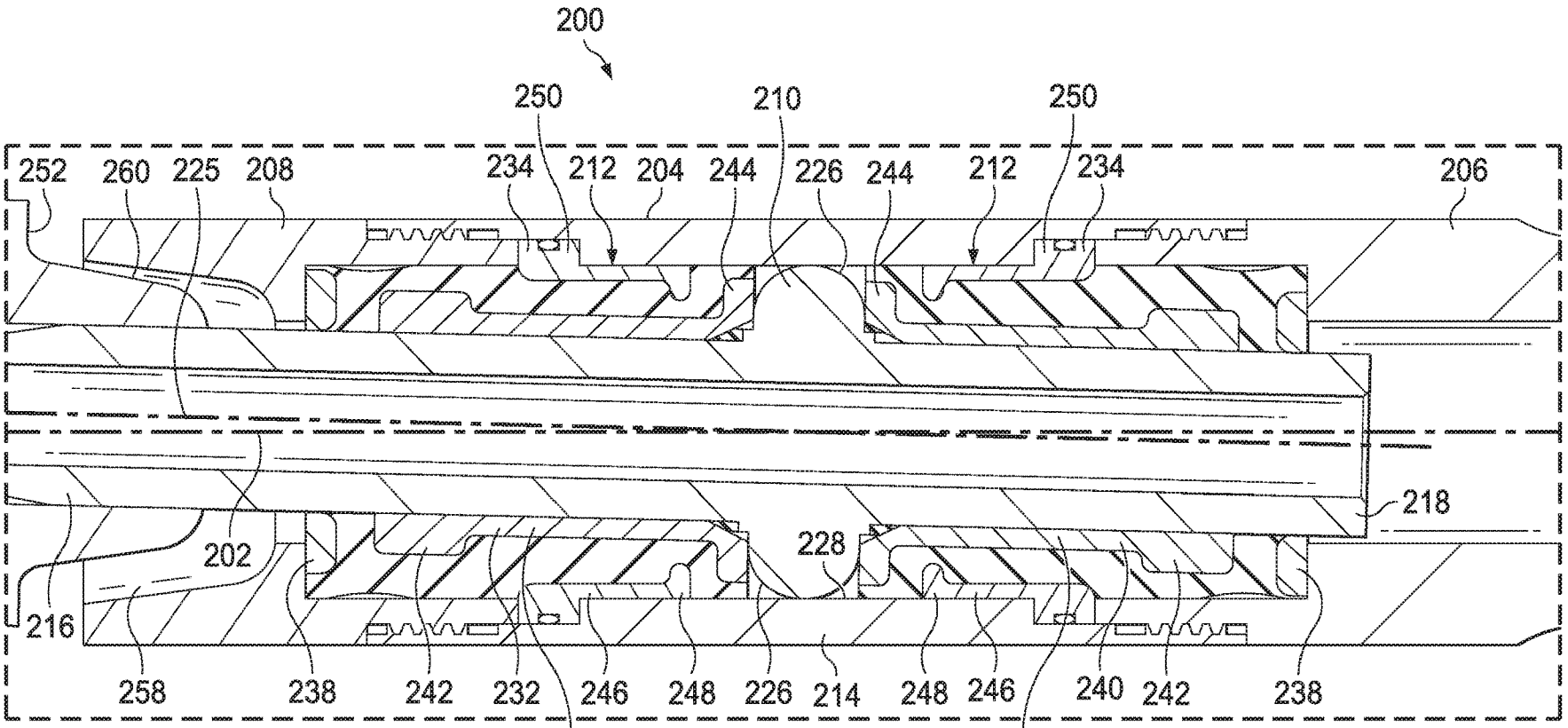
FIG. 9 is detailed cross-sectional view of the lateral isolator of FIG. 8.

Even though the polygonal exterior profiles 222 described herein prevent relative angular movement (e.g., rotation) of the inner member 210 relative to the housing 204 about the central axis 202, the inner member 210 is allowed to move both longitudinally relative to the housing 204 and/or in a pivoting or cocking motion relative to the housing 204. The pivoting or cocking motion can allow, in some example embodiments, for up to and/or at least 1.5 degrees of relative deviation between an inner member central axis 225 of the inner member 210 and the central axis 202, as shown in FIGS. 8 and 9. The amount of relative movement allowed between the inner member 210 and the housing 204 is limited by the presence of the tubeform assemblies 212. Different amounts of relative angular deviation, both greater and smaller, between the inner member central axis 225 and the central axis 225 may be provided from the example value of 1.5 degrees provided herein.

Referring primarily to FIG. 7, each tubeform assembly 212 comprises an inner retainer 232, an outer retainer 234, elastomeric package 236 disposed at least partially between the inner retainer 232 and the outer retainer 234, and an end ring 238. The inner retainer 232 is generally tubular (e.g., in the shape of a hollow cylinder) in shape and includes a central portion 240 comprising a substantially constant inner diameter suitable for receiving the second tubular portion 218 of the inner member 210. The inner retainer 232 includes a captured lip 242 disposed at a first end of the central portion 240. The captured lip 242 has an inner diameter substantially similar to the inner diameter of the central portion 240, but has an outer diameter that is larger than an outer diameter of the central portion 240. The inner retainer 232 also includes a flared end portion 244 disposed at a second end of the central portion 240. The flared end portion 244 has a flared or gradually increasing inner diameter and an external diameter larger than the external diameter of the captured lip 242.

The outer retainer 234 includes a central portion 246 having an outer diameter suitable for being received within the shoulder 214 of housing 204. The outer retainer 234 also has an inward abutment ring 248 disposed at a first end of the central portion 246 and an outer abutment ring 250 disposed at a second end of the central portion 246. The inward abutment ring 248 has an outer diameter substantially the same as the outer diameter of the central portion 246 but has an inner diameter that is smaller than the inner diameter of the central portion 246. The outer abutment ring 250 has an inner diameter substantially the same as the inner diameter of the central portion 246 but has an outer diameter that is larger than the outer diameter of the central portion 246.

The elastomeric package 236 is disposed, at least partially, in a space radially between inner retainer 232 and outer retainer 234. The elastomeric package 236 is also disposed, at least partially, in a space longitudinally between the flared end portion 244 and the inward abutment ring 248. Further, the elastomeric package 236 is disposed, at least partially, in a space radially between the inner retainer 232 and the housing cap 208. A portion of the elastomeric package 236 is also disposed, at least partially, longitudinally between the captured lip 242 and the end ring 238. The end ring 238 has an inner diameter configured to receive (e.g., the same size, or larger than) the first tubular portion 216 and an outer diameter that is smaller than an inner diameter of the housing cap 208. In this embodiment, a portion of the elastomeric package 236 is disposed radially between the end ring 238 and the housing cap 208. Because the elastomeric package 236 is elastically deformable, the inner member 210 is movable relative to the housing 204 as a function of deforming the elastomeric package 236, but the movement of the inner member 210 relative to the housing 204 is limited by the limited compressibility of the elastomeric material of the elastomeric package 236, as well as the limited amount of free space into which the elastomeric material can be displaced. In this embodiment, the tubeform assemblies 212 are provided so that the elastomeric packages 236 are pre-compressed (e.g., in the axial direction), thereby maintaining a preload on the elastomer that eliminates gapping and reduces the effects of compression set. Under extreme axial loads applied to the tubeform assemblies 212, the elastomer of the elastomeric packages 236 is allowed to bulge and fill free volume within the surrounding structure so that the elastomeric material bulk loads to control an amount of shear within the elastomeric material. This can be particularly useful when the elastomeric material comprises rubber.

Referring primarily to FIG. 6, the first tubular portion 216 of the inner member 210 is connected to a movable sub 252. The movable sub 252 is configured to receive a reduced neck portion 254 of the first tube portion 216 and a sub nut 256 is received within the movable sub 252 and configured to threadingly engage the reduced neck portion 254, thereby capturing the movable sub 252 relative to the inner member 210 and ensuring that movement of the inner member 210 causes similar movement to the movable sub 252 and vice versa. The reduced neck portion 254 is a distal portion of the first tubular portion 216 having a reduced outer diameter as compared to the proximal portion of the first tubular portion 216, the proximal portion of the first tubular portion 216 being adjacent to and/or in contact with the pivot ring 220. The housing cap 208 comprises a bowl profile 258 configured to receive a guide neck 260 of the movable sub 252, the guide neck 260 having an outer profile generally complementary to the bowl profile 258. In this embodiment, at least a portion of the guide neck 260 remains received longitudinally within the housing cap 208, thereby ensuring that relative longitudinal movement of the inner member 210 relative to the housing 204 does not result in the movable sub 252 becoming hung on an uninclined surface (e.g., a flat end surface) of the housing cap 208. Also, the bowl profile 258 and the guide neck 260 have substantially similar contoured contact surfaces to work together to prevent excess or harmful cocking deviation of the inner member 210 relative to the housing 204.

Still referring primarily to FIG. 6, the centralizer sub 206 extends away from the housing 204 (e.g., in the direction of the central axis 202) and comprises a carrier portion 262 comprising an outer diameter that is reduced, or smaller, compared to the outer diameter of the housing 204 and/or other portions of the centralizer sub 206. The centralizer sub 206 further comprises compliant fins 264 carried by (e.g., rigidly attached to) the carrier portion 262. In the example embodiment shown, the centralizer sub 206 includes three compliant fins 264 disposed about the central axis 202 in an evenly distributed angular array (e.g., spaced apart from each other with an angular pitch of about 120 degrees). The compliant fins 264 are configured for a directional installation relative to anticipated fluid flow along the exterior of the lateral isolator 200. More specifically, each compliant fin 264 includes a downstream incline surface 266 that gradually decreases an outer diameter of the compliant fin 264 along the longitudinal length of the compliant fin 264 in the direction of fluid flow 261. In contrast, a relatively blunt upstream incline surface 268 (e.g., having a larger angle relative to the central axis 202 than the downstream incline surface 266) of the compliant fin 264 is provided. In this embodiment, the compliant fins 264 are constructed at least partially of elastomeric material, so that the lateral isolator 200 provides additional lateral and/or cocking compliance beyond the features disclosed elsewhere herein. The compliant fin 264 shape provides a varying load area that changes with respect to the amount of force on the face 263. Under small loads, the face 263 has a smaller load area when compared to large loads. The face 263 can bulge to enable the non-linear stiffness behavior of the compliant fin 264. As the compliant fin 264 is compressed radially, the surface area of the face 263 acting as a contact surface will increase due to the radial compression of the compliant fin 264, thereby providing the varying, or variable, load area referenced herein.

Still referring primarily to FIG. 6, the lateral isolator 200 is shown with an optional movable sub protector 270, which is threadingly engaged to the movable sub 252, and an optional centralizer sub protector 272, which is threadingly engaged to the centralizer sub 206. The movable sub protector 270 and the centralizer sub protector 272 can be provided on the lateral isolator 200 to protect the internal connection threads 274 of the movable sub 252 and the external connection threads 276 of the centralizer sub 206, respectively, when the lateral isolator 200 is not yet installed within the drill string 102 of an HRS 100.

Figure 10:
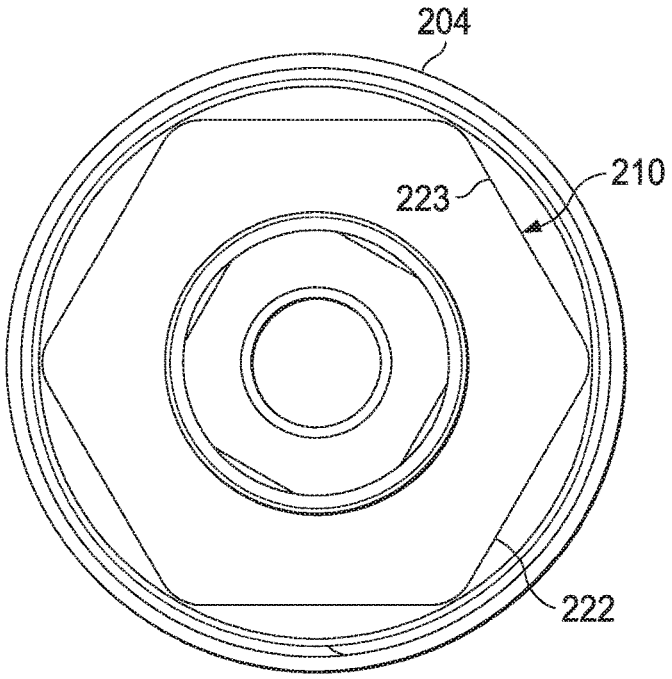
FIG. 10 is a partial internal end view of the lateral isolator of FIG. 3.

Referring now to FIG. 10, a longitudinal end view of the inner member 210 is shown disposed within housing 204, with some components of the lateral isolator 200 being omitted from this view. The polygonal exterior profile 222 of inner member 210 is matched by (e.g., has an outer surface that is substantially the same size and shape as the outer surface of) a complimentary polygonal profile 223 of housing 204.

Figure 11:
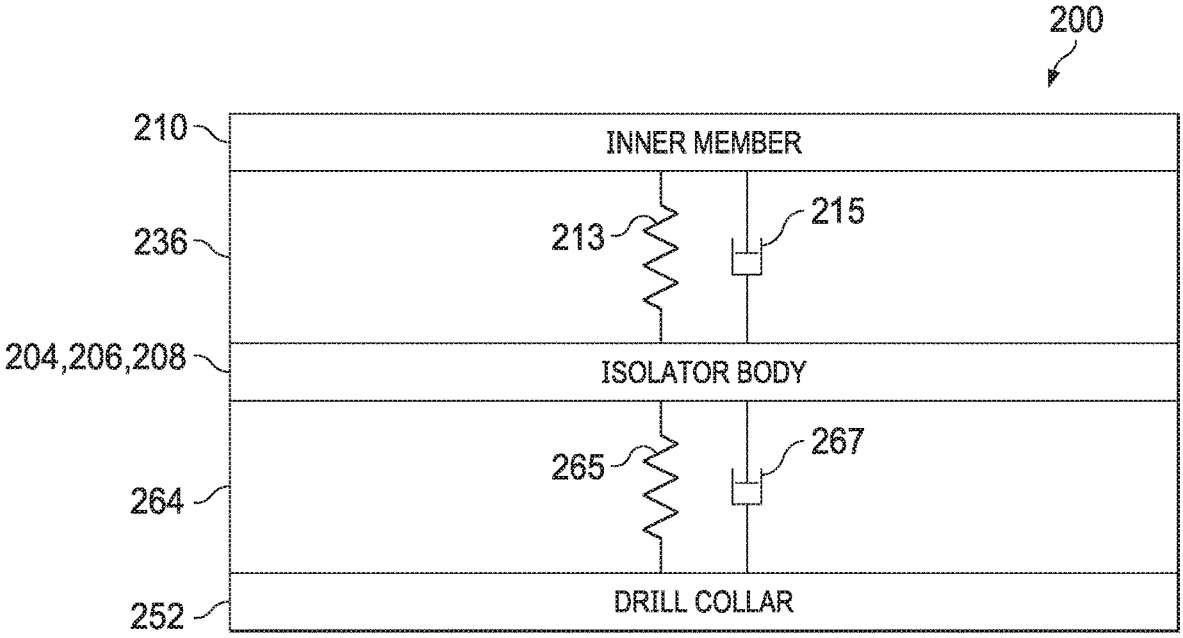
FIG. 11 is a schematic representation of the lateral isolator of FIG. 3.

Referring now to FIG. 11, a simplified schematic representation of the lateral isolator 200 can be described more generally as a series spring/damper system where the elastomeric components, the elastomeric packages 236 and the compliant fins 264, provide both spring and damping characteristics to the lateral isolator 200. More specifically, the lateral isolator 200 is shown with kinematic connections between the unitary combination of the housing 204, centralizer sub 206, and housing cap 208 (labeled collectively as "ISOLATOR BODY" in FIG. 11) and each of the inner member 210 and the movable sub 252 (labeled as "DRILL COLLAR" in FIG. 11), these kinematic connections being the elastomeric package(s) 236 and the compliant fins 264, respectively. The elastomeric packages 236 are shown as having a spring force component 213 and a damping force component 215. The compliant fins 264 are shown as having a spring force component 265 and a damping force component 267. Because the lateral isolator 200 comprises two unique sets of elastomeric components, the elastomeric packages 236 and the compliant fins 264, the lateral isolator 200 can be referred to as a dual stage isolator.

Dual stage isolation can be provided by the lateral isolator 200 by tuning the two different sets of elastomeric components to any of a variety of performance characteristics, such as, for example, by selecting optimized stiffness and damping characteristics. For example, the dual stage isolation can be achieved by providing elastomeric packages 236 that are softer (e.g., have lower stiffness values) than the compliant fins 264, which can be harder, or stiffer, than the elastomeric packages 236. Alternatively, the dual stage isolation can be achieved by providing compliant fins 264 that are softer (e.g., have lower stiffness values) than the set of elastomeric packages 236, which can be harder, or stiffer, than the compliant fins 264. These arrangements allow for higher displacement under an aggressive, or large magnitude, force input and boosts lateral isolator 200 performance by more effectively mitigating shock by extending the duration of the input into the lateral isolator 200 system occurs. In some embodiments, stiffness of compliant fins 264 can be about 1,200 pounds per inch (lbs/in) to about 2,200 lbs/in to ensure proper operation of the dual stage isolation characteristics of the lateral isolator 200. Of course, compliant fin 264 and elastomeric package 236 stiffness and geometries can be scaled or tailored to be appropriate for applications other than use with HRS 100. In some cases, compliant fins 264 can be replaced by other compliant centralizing components, such as, for example, a drill pipe centralizer. Generally, the lateral isolator 200 can be scaled by using substantially the same design but with changes to material or geometry to satisfy different design constraints, such as larger or smaller ranges of frequency responsiveness or load capability.

The lateral isolator 200 is designed to be operated, in most circumstances, with an axial isolator, such as axial isolator 121. Because axial shocks are not to be primarily handled by (e.g., absorbed and/or dissipated by) the lateral isolator 200, the lateral isolator 200 is designed to have a high stiffness rating in the axial direction to limit strain on the elastomeric packages 236, thereby increasing the service life of the elastomeric packages 236. During high amplitude axial input shock events, the tubeform assemblies 212 are configured to allow full bulk loading in a compression region of the elastomer by capturing elastomer between the end ring 238 and the captured lip 242 and also between the flared end portion 244 and the inward abutment ring 248. This bulk loading behavior restricts motion and keeps strain levels of the elastomeric packages 236 within acceptable limits.

The lateral isolator 200 can provide some torsional isolation and shock protection to the drill string 102 and/or a tool string 402 as well. As explained elsewhere herein, the inner member 210, tubeform assemblies 212, and collective isolator body (e.g., the housing 204, the centralizer sub 206, and the housing cap 208) are all rotatably interlocked using polygonal profiles to provide torsional compliance through the elastomer region and eliminate motion across hard components. The component sizing tolerances are configured and selected to allow the largest gap to exist between the polygonal profile (e.g., 222) of the inner member 210 and the complimentary polygonal profile (e.g., 223) of the housing 204 to allow for torsional compliance between the downstream and upstream connections made to the lateral isolator 200. As the center pivot polygon profile (e.g., 222) of the pivot ring 220 wears (e.g., due to frictional contact with adjacent surfaces) during use, the torsional compliance provided by the lateral isolator 200 increases due to wearing of the polygon interface surfaces (e.g., 222, 223), thereby increasing torsional isolation provided by the lateral isolator 200 during the operational life of the lateral isolator 200.

Figure 12:
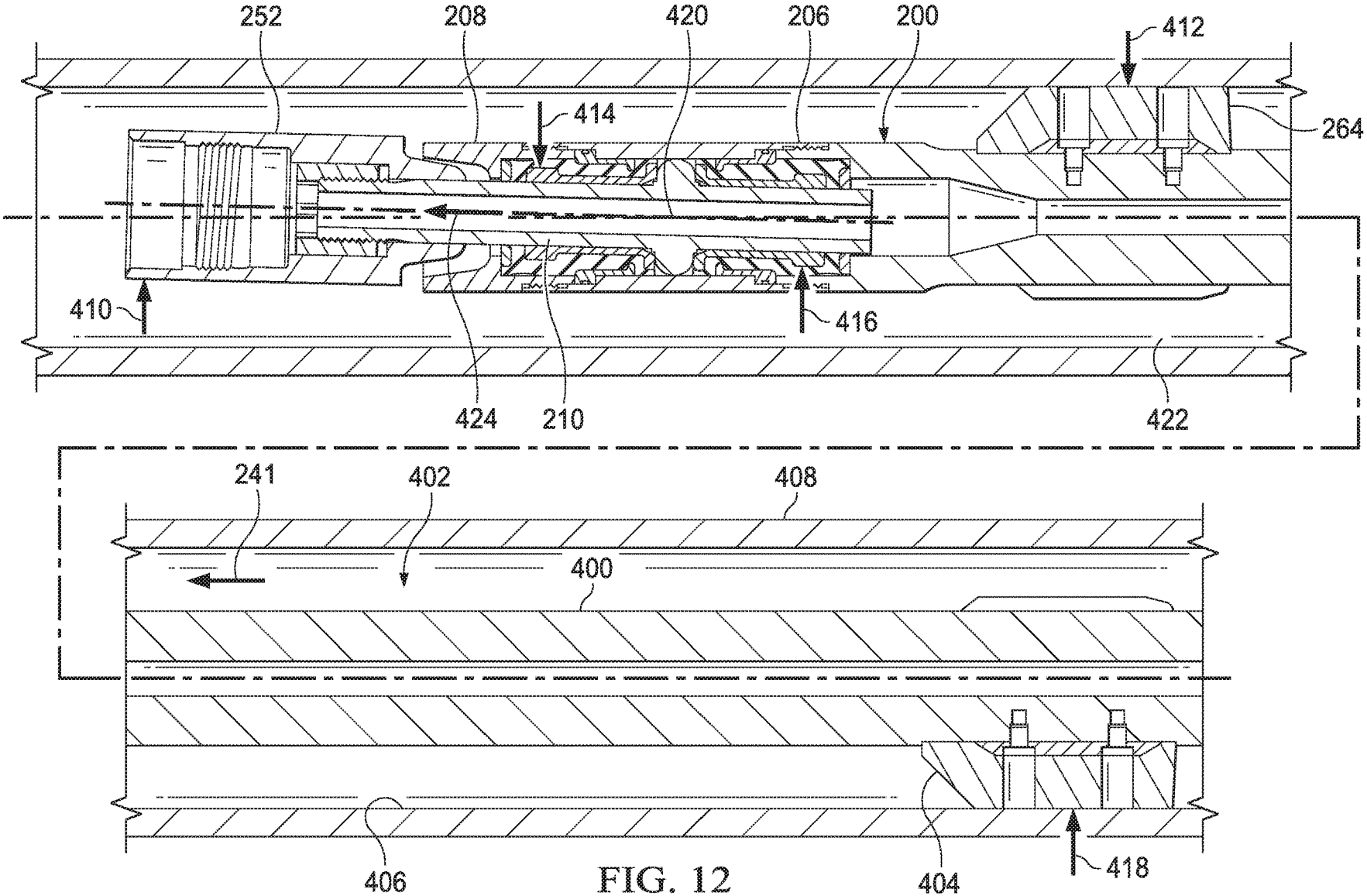
FIG. 12 is a simplified force reaction diagram of the lateral isolator of FIG. 3.
Figure 13:
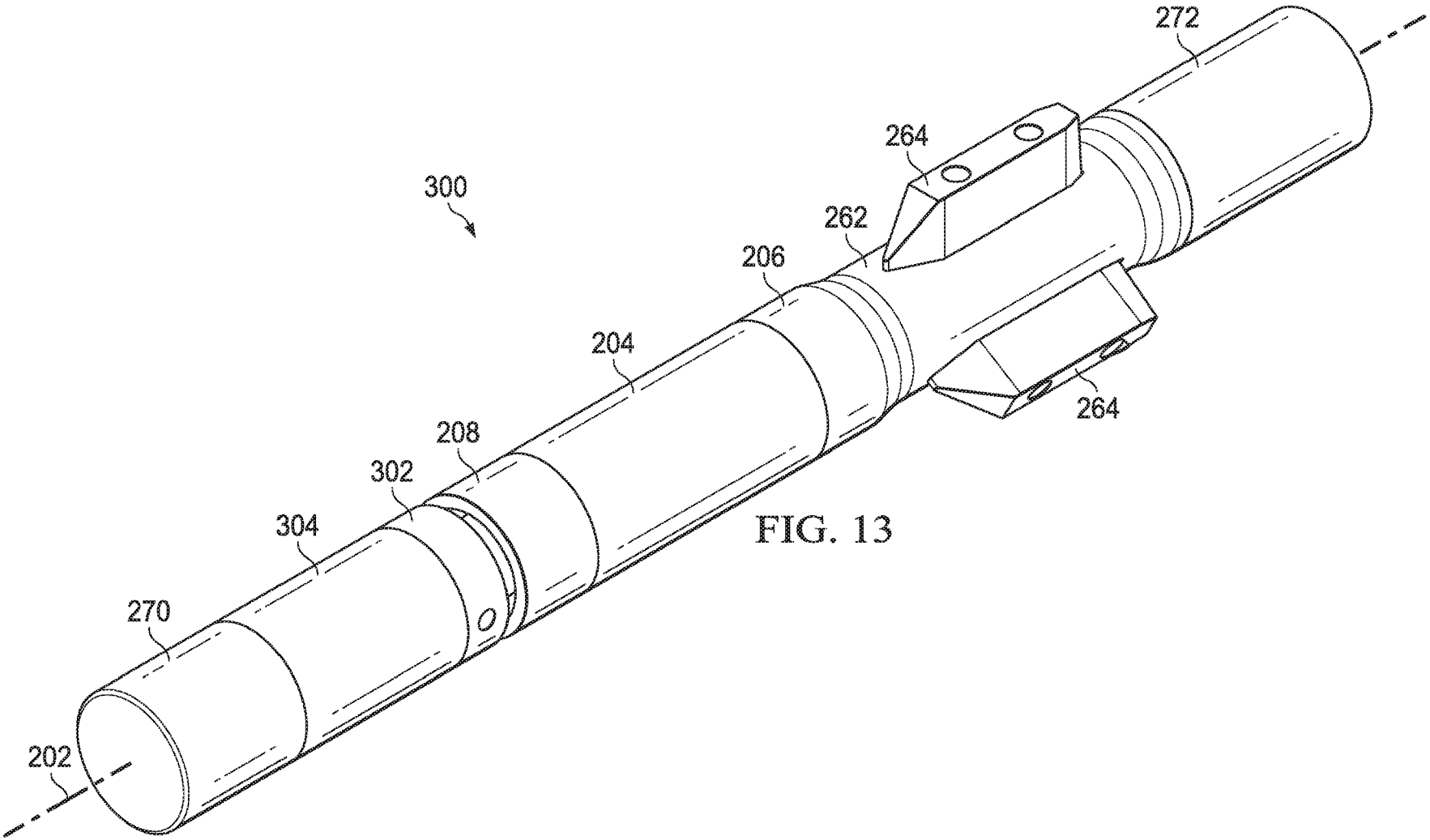
FIG. 13 is an oblique view of a second example embodiment of a lateral isolator.
Figure 14:
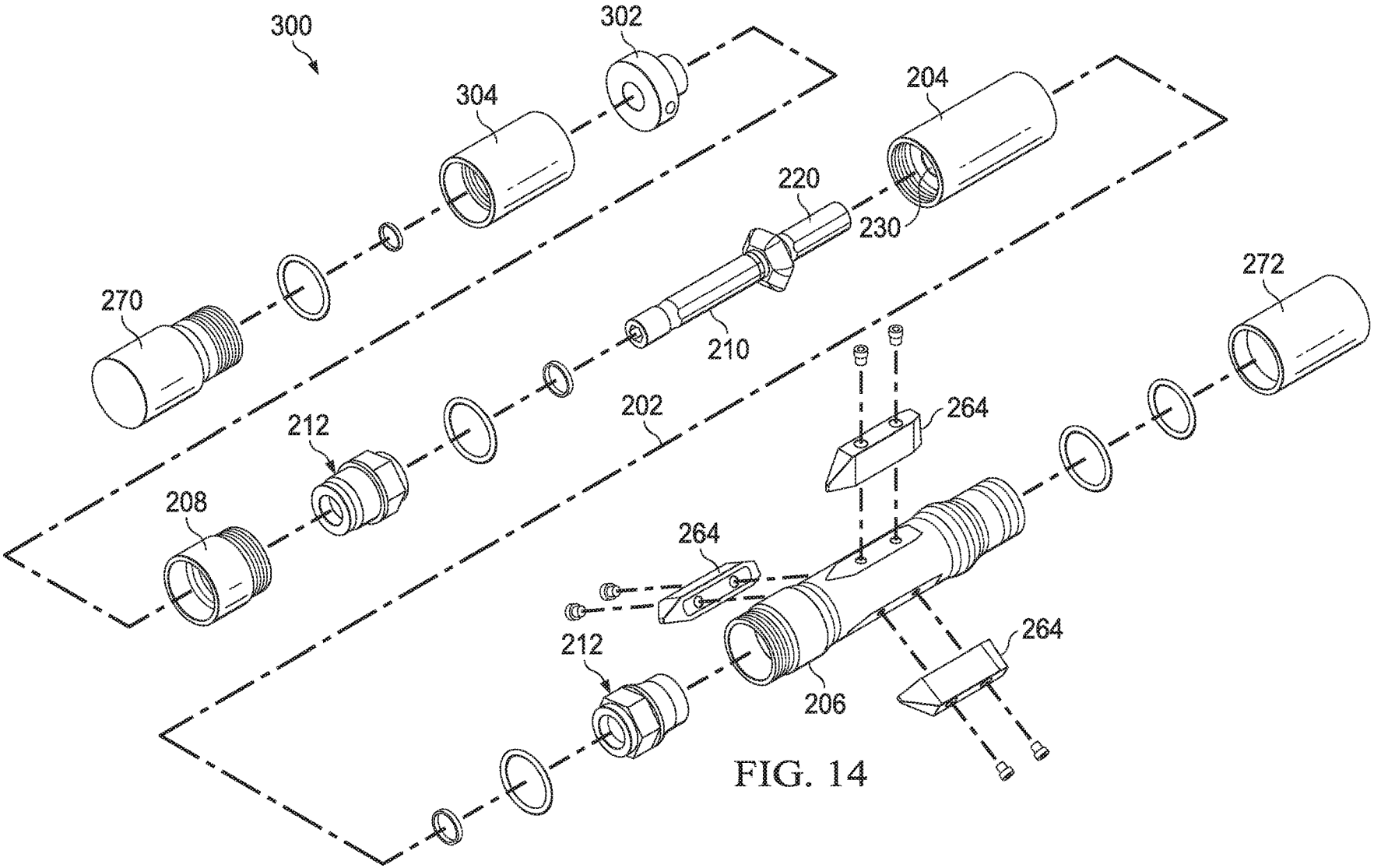
FIG. 14 is an oblique exploded view of the lateral isolator of FIG. 13.
Figure 15:
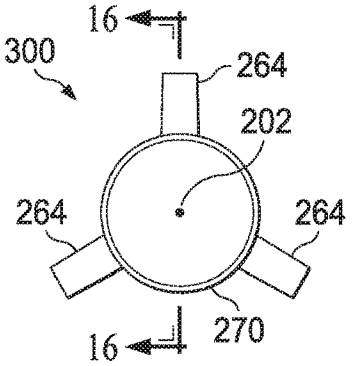
FIG. 15 is a top view of the lateral isolator of FIG. 13.
Figure 16:
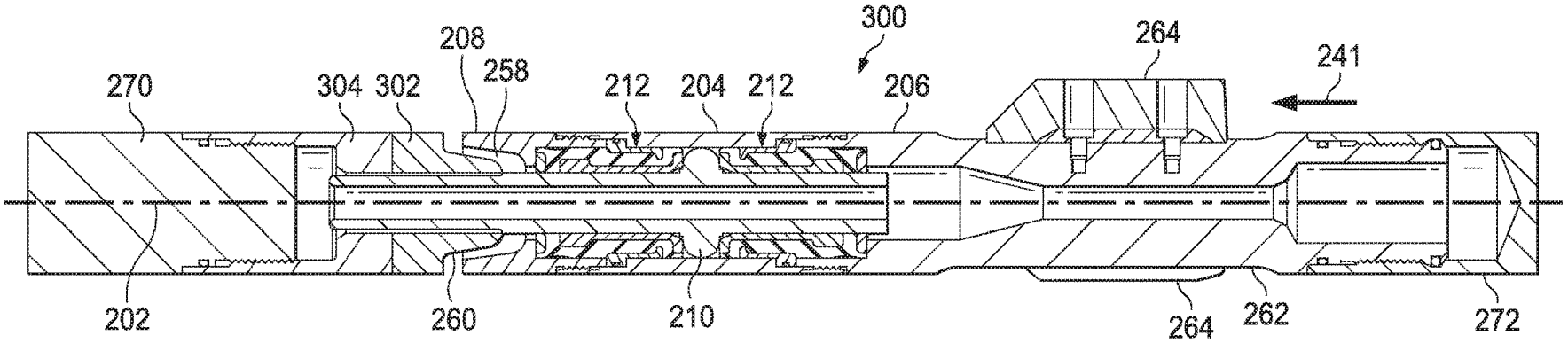
FIG. 16 is a cross-sectional side view of the lateral isolator of FIG. 13, taken along cutting line 16-16 of FIG. 15.

Referring now to FIG. 12, a simplified force reaction diagram of a lateral isolator 200 in use is shown. When in use, the lateral isolator 200 is typically deployed in conjunction with another tool string component 400 connected in series along the length of the tool string 402. In most applications, the tool string component 400 will comprise a centralizer 404. The centralizer 404 can comprise, or be in the shape of, a plurality of radially arranged fins substantially similar to compliant fins 264 in shape, stiffness, and/or damping characteristics. However, the centralizer 404 may be shaped differently and may contact an interior wall 406 of a tubular component 408 differently as compared to how compliant fins 264 contact the tubular component 408.

When the lateral isolator 200 and the tool string component 400 are deployed within the tubular component 408, a substantially lateral input force 410 may be introduced (e.g., in a substantially radial direction, relative to the central axis 202) to the lateral isolator 200 at the movable sub 252. The lateral input force 410 is typically provided to the lateral isolator 200 by a component connected to the movable sub 252 at an opposite end from which the inner member 210 is connected thereto, in series along the tool string 402. The lateral input force 410 is reacted to by an opposing fin force 412 that represents the interior wall 406 opposing the radial movement of one more compliant fins 264 as the compliant fins 264 are pressed against the interior wall 406 in response to the lateral input force 410 being transferred through the lateral isolator 200. When the lateral input and fin forces 410, 412 are of a sufficient magnitude, the inner member 210 pivots about the pivot ring 220 so as to be inclined, or cocked, relative to the rigid surrounding outer portions, such that the inner member central axis 225 is no longer coaxial with, or parallel to, the central axis 202, thereby providing lateral bending compliance and preventing the need to accommodate such bending forces as are required to be accommodated in rigidly attached tool string components known from the prior art.

As shown, the lateral bending compliance is achieved by compressing elastomeric packages 236 between the inner member 210 and at least the housing cap 208, resulting in a downstream reaction force 414, and between the inner member 210 and at least the centralizer sub 206, resulting in an upstream reaction force 416. In response to the lateral input and fin forces 410, 412, the overall bending inputs to the tool string 402 can be balanced by radial movements of the centralizer 404 being opposed by contact with the interior wall 406, thereby generating a balancing force 418. FIG. 12 is also helpful in illustrating that, when the lateral isolator 200 is disposed within the tubular component 408 (e.g., a wellbore), the lateral isolator 200 defines a lateral isolator pressure column 420 longitudinally through the center of the lateral isolator 200 and a separate exterior pressure column 422 that is between the exterior of the lateral isolator 200 and the tubular component 408. The lateral isolator pressure column 420 is pressure independent from the exterior pressure column 422. Further, a fluid flow direction 424 within the lateral isolator pressure column 420 is in the same direction as the fluid flow direction 241 of the exterior pressure column 422.

Referring now to FIGS. 13 to 16, a second example embodiment of a lateral isolator, generally designated 300, is shown. The lateral isolator 300 is substantially similar to lateral isolator 200, but rather than comprising the movable sub 252 and associated sub nut 256 shown and described in the lateral isolator 200, the lateral isolator 300 comprises a movable sub 304 and a spanner nut 302, which is disposed between the movable sub 304 and the housing cap 208. Each of the spanner nut 302 and the movable sub 304 are configured for threadingly engaging with a threaded portion (e.g., a reduced neck portion 254, see FIG. 6) of the first tubular portion 216 of the inner member 210.

In operation, the lateral isolators 200, 300 can mitigate, or reduce, lateral shock and vibration caused by downhole drilling compared to conventional rigidly attached and/or assembled tool strings and/or drill strings, thereby preventing premature electronic and/or sensor failures caused by lateral vibrations and shock within the drill string 102. The lateral isolators 200, 300 can also mitigate, or reduce, lateral vibrations induced by drill string 102 whirling compared to conventional rigidly attached and/or assembled drill strings. Providing the lateral isolators 200, 300 effectively mounts the sensitive components of the tool string within the drill string 102 in a manner that provides a relatively soft joint that allows cocking and lateral movement between components of the tool string 402 and/or the drill string 102 attached thereto, as opposed to being rigidly mounted and/or only providing axial vibration and shock reduction. The lateral isolators 200, 300 provide the improved cocking and lateral movement, while high axial stiffness of the lateral isolators 200, 300 prevents damage to the elastomeric components by limiting shear deformation of the elastomeric components. Further, the centralizer sub 206 and associated compliant fins 264 provide the tool string 402 and/or the drill string 102 stability and control, as well as additional lateral compliance characteristics for the lateral isolators 200, 300. The increased stability of the tool string 402 and/or the drill string 102 increases fatigue life of the system and maintains centralization of the MWD/LWD electronics.

Additionally, because the lateral isolators 200, 300 are configured to maintain angular orientation while providing the lateral and cocking compliance, orientation and directionality of the MWD/LWD electronics are maintained, so that reference planes and direction in gyroscopes, accelerometers, and magnetometers are maintained and target locations are successfully reached. Similarly, since the angular orientations are maintained, drilling safety is improved due to the drill string being better prevented from entering off-limits regions and/or other wells. According to alternative embodiments of the disclosure, an HRS 100 may comprise two or more (e.g., a plurality of) lateral isolators 200, 300 connected (e.g., in series) along the drill string 102 and/or the tool string 402.

The lateral isolators 200, 300 can be particularly useful in mitigating high lateral shocks to the isolated mass 112. When the isolated mass 112 carries battery packs, the lateral isolators 200, 300 may prevent immediate explosion of the battery packs in response to high lateral shocks. The lateral isolators 200, 300 can also prevent fatigue in solder joints, wires, and mounts of an isolated mass 112. Further, the lateral isolators 200, 300 can prevent stress cracking of pressure barrels of a drill string and/or tool string, thereby preventing failure of the drill string and/or tool string. The lateral isolators 200, 300 also allow an isolated mass 112 to survive longer in an aggressive drilling environment, where lateral shock and vibration are larger than in conservative drilling environments.

The lateral isolators 200, 300, when configured as dual stage isolators where one set of elastomeric components is tuned to have a first frequency response range and a second set of elastomeric components is tuned to have a second frequency response range. different from the first frequency response range, can provide a non-linear spring rate system that allows for infinite stiffness values to mitigate high frequency low amplitude inputs, as well as low frequency, high amplitude inputs. When low input events are received by the lateral isolators 200, 300 as configured in the manner described above, the lateral isolators 200, 300 can behave as "soft" isolators, while, when high input events are received by the lateral isolators 200, 300, the lateral isolators 200, 300 can behave as "hard" isolators by asymptotically stiffening to control motion to a soft snub. Put another way, the lateral isolators 200, 300 can, as a gradual stiffness is increased, provide a gradual stop to movements resulting from the excitation force inputs. Further, the lateral isolators 200, 300 provide a soft joint in the tool string and/or drill string to allow bending to occur through the elastomer rather than bending metal components, thereby increasing the life span of the rigid components of the tool string and/or drill string. As described above, the lateral isolators 200, 300 can mitigate shock and vibration in the lateral and/or cocking directions to reduce vibration and shock transmission into the electronics of an isolated mass, such as isolated mass 112, or other sensitive electronics of a tool string, thereby enabling improved longevity and reliability of the electronics. The lateral isolators 200, 300 also increase control over the operation of a drill string and/or tool string by incorporating the spring and damper system into a single component having elastomeric components. The elastomeric components effectively increase the duration of an input to the lateral isolators 200, 300 and remove undesirable energy simultaneously to lessen the output movement from the lateral isolators 200, 300 as compared to the input movement.

Figure 17:
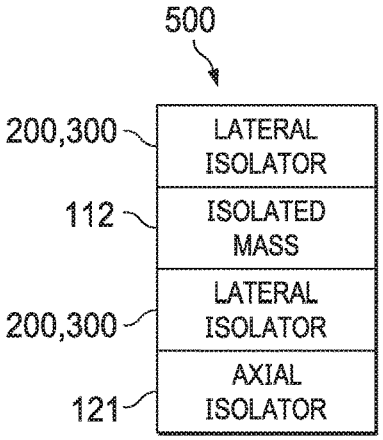
FIG. 17 is a simplified representation of a second example embodiment of a tool string arrangement according to this disclosure.

Referring now to FIG. 17, a schematic illustration of a second example embodiment of a tool string, generally designated 500, is shown. The tool string 500 includes an isolated mass 112 disposed in series between at least two lateral isolators 200, 300. An axial isolator 121 is disposed serially along the tool string 500, axially beyond the at least two lateral isolators 200, 300.

Figure 18:
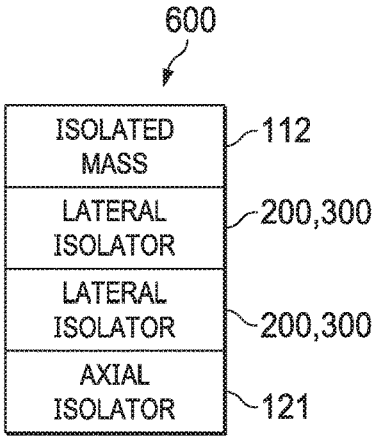
FIG. 18 is a simplified representation of a third example embodiment of a tool string arrangement according to this disclosure.

Referring now to FIG. 18, a schematic illustration of a third example embodiment of a tool string, generally designated 600, is shown. The tool string 600 includes at least two lateral isolators 200, 300, which are disposed between an isolated mass 112 and an axial isolator 121.

Figure 19:
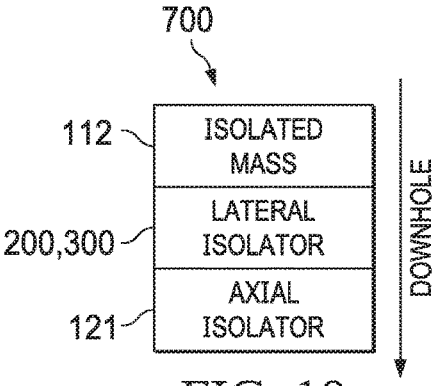
FIG. 19 is a simplified representation of a fourth example embodiment of a tool string arrangement according to this disclosure.

Referring now to FIG. 19, a schematic illustration of a fourth example embodiment of a tool string, generally designated 700, is shown. The tool string 700 includes a single lateral isolator 200, 300 disposed between an isolated mass 112 and an axial isolator 121.

Figure 20:
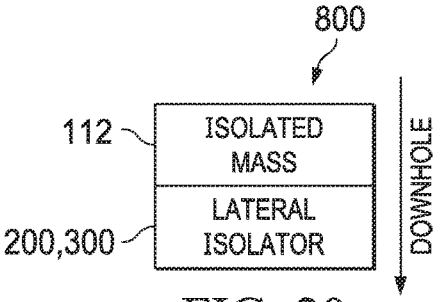
FIG. 20 is a simplified representation of a fifth example embodiment of a tool string arrangement according to this disclosure.

Referring now to FIG. 20, a schematic illustration of a fifth example embodiment of a tool string, generally designated 800, is shown. The tool string 800 includes a single lateral isolator 200, 300 disposed below (e.g., in the direction of the drill bit 106, see FIG. 1) an isolated mass 112. In some such embodiments, the tool string 800 does not comprise an axial isolator.

Figure 21:
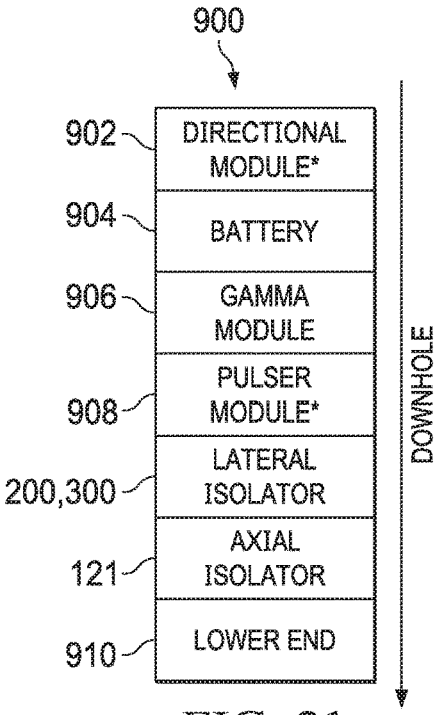
FIG. 21 is a simplified representation of a sixth example embodiment of a tool string arrangement according to this disclosure.

Referring now to FIG. 21, a schematic illustration of a sixth example embodiment of a tool string, generally designated 900, is shown. The tool string 900 includes a directional module 902, a battery 904, a gamma module 906, a pulser module 908, a lateral isolator 200, 300, an axial isolator 121, and a lower end 910, disposed in the order listed and ending with the lower end being the component of the tool string that is closest to the drill bit (see, e.g., 106, FIG. 1).

Figure 22:
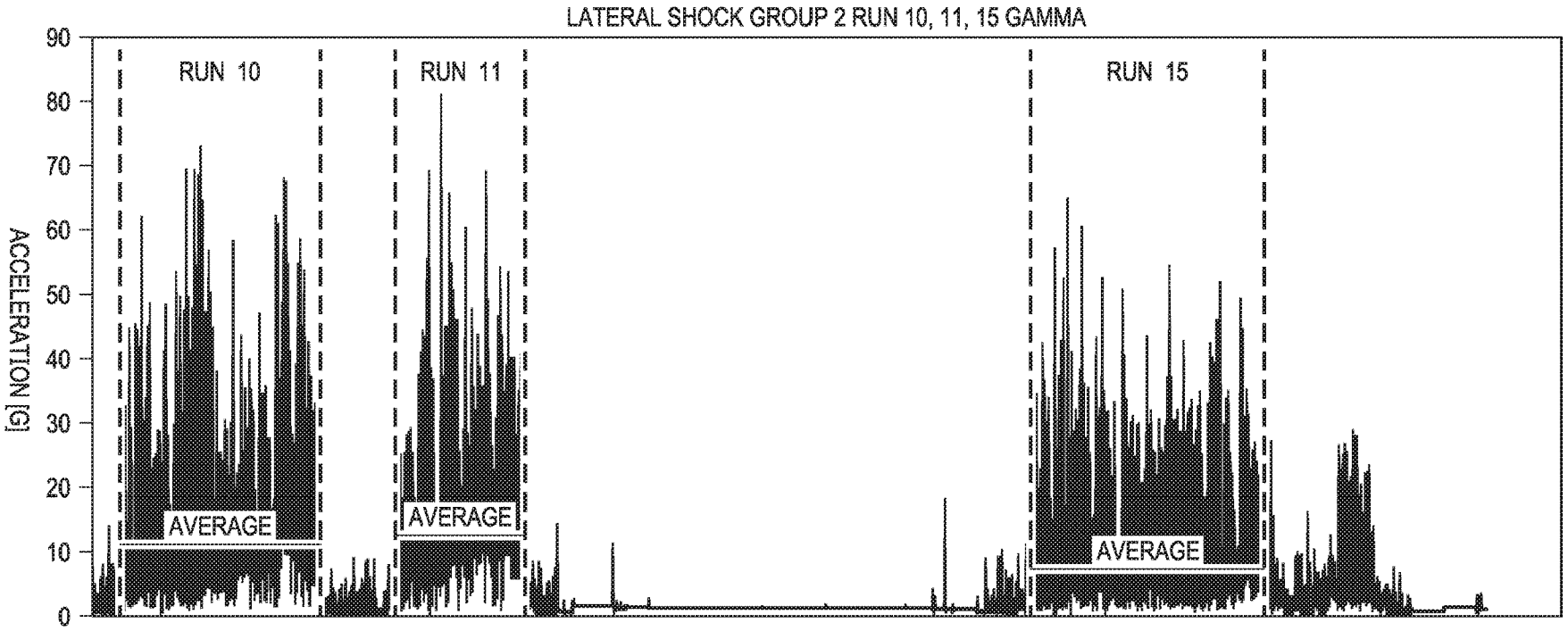
FIG. 22 is a graph of run data obtained when operating the tool string of FIG. 21.

Referring now to FIG. 22, a graphical plot of run data during operating the tool string 900 of FIG. 21 is shown. The run data was acquired in a lateral segment in comparable run conditions. Each configuration was run five times, with data pulled from the pulser module 908, gamma module 906, and directional module 902. Results showed favorable shock reduction with the greatest reduction being observed in the components along the tool string 900 that are closest to the lateral isolator 200, 300. The lateral isolator 200, 300 provided the highest shock reduction near the pulser module 908 and the gamma module 906. It is thought that the enhanced shock reduction observed at the pulser module 908 and the gamma module 906 is due to the close proximity of the lateral isolator 200, 300 to these components. Shock reduction performance was observed to be greatest in components of the tool string 900 that have greater exposure to high (>30 g) shock events typically observed adjacent the lower end 910 of the tool string 900. The lateral isolator 200, 300 is observed to perform incrementally better as shock inputs increase in magnitude.

Data was compiled using the start and end point of the tool string 900. Runs 10, 11, and 15 were measured at the gamma module 906. Runs 10 and 11 were obtained in a tool string having a standard axial isolator, while Run 15 was obtained in a tool string having a finned axial isolator 121 and lateral isolator 200, 300. Overall, the goal of reducing lateral shock and vibration in this series of run data was achieved. The tools performed as expected and showed a direct correlation of reducing lateral shock and vibration when a lateral isolator 200, 300 and finned axial isolator 121 were paired together in a tool string. The finned axial isolator 121 provided a stabilized lower end 910, while the lateral isolator 200, 300 decoupled shock inputs at the lower end 910 from the remainder of the components of the tool string 900.

Referring now to FIG. 23, run data obtained from the pulser module 908 is shown. The run data showed an average shock reduction of approximately 30%. However, the shock isolation and reduction benefit is seen in the normalized data for shock counts per hour. Results show approximately an 88% reduction of shock counts greater than 30 g. The results also confirmed that the shock isolation and reduction benefits are realized when higher shock inputs are received.

Referring now to FIG. 24, run data obtained from the gamma module 906 is shown. The run data showed an average shock reduction of approximately 31%. Like with the pulser module 908 data of FIG. 23, the shock isolation and reduction benefits are seen in shock counts per hour. Results show approximately a 76% reduction of shock counts greater than 30 g. The results also confirmed that the shock isolation and reduction benefits are realized when higher shock inputs are received.

Referring now to FIG. 25, run data obtained from the directional module 902 is shown. The run data showed an average shock reduction of approximately 10%. The shock isolation and reduction characteristics are more attenuated (e.g., less) at the directional module 902 due to the lower overall shock inputs. Also, there was less run data on the directional module 902, so conclusions are not as defined as the gamma module 906 and pulser module 908 run data shows in FIGS. 23 and 24.

Referring now to FIGS. 26A and 26B, detailed shock values, counts, and reductions by run of the tool string 900 are provided.

It will be appreciated that the type of isolation provided by a lateral isolator 200, 300 can be provided by a drill string level component and/or a tool string level component to reduce the transmission of lateral shocks along, and to other components of, a drill string and/or a tool string by similarly providing one or more components with a mechanism comprising at least an inner member 210 and a tubeform assembly 212.

Other embodiments of the current invention will be apparent to those skilled in the art from a consideration of this specification or practice of the invention disclosed herein. Thus, the foregoing specification is considered merely exemplary of the current invention with the true scope thereof being defined by the following claims.

What is claimed is:

1. A lateral isolator comprising:

a housing comprising an upstream end and a downstream end;

an inner member comprising a pivot ring disposed within the housing;

a first elastomeric package disposed between the housing and the inner member, at a position longitudinally between the pivot ring and the upstream end; and a second elastomeric package disposed between the housing and the inner member, at a position longitudinally between the pivot ring and the downstream end;

wherein the inner member is pivotable, relative to the housing, between an inclined state and a non-deflected state;

wherein, when the inner member is in the inclined state, the inner member is positioned such that a central axis of the inner member is not coaxial with or parallel to a central axis of the lateral isolator; and wherein, when the inner member is in the non-deflected state, the inner member is positioned such that the central axis of the inner member is coaxial with or parallel to the central axis of the lateral isolator.

2. The lateral isolator of claim 1, comprising a centralizer sub attached at the upstream end of the housing, the centralizer sub comprising a plurality of compliant fins attached to an outer surface of the centralizer sub and being spaced radially apart from each other about a longitudinal central axis of the lateral isolator.

3. The lateral isolator of claim 2, wherein the first elastomeric package and the second elastomeric package are configured to collectively respond to a first input force frequency range, wherein the plurality of compliant fins are configured to collectively respond to a second input force frequency range, and wherein the second input force frequency range is different than first input force frequency range.

4. The lateral isolator of claim 2, wherein each of the compliant fins is configured such that, when a first compliant fin of the compliant fins is radially compressed, an area of an outer face of the compliant fin, which is in contact with a structure in which the lateral isolator is positioned increases to provide a nonlinear stiffening force to the lateral isolator.

5. The lateral isolator of claim 2, wherein, when the lateral isolator is disposed in a wellbore, the lateral isolator maintains a lateral isolator pressure column through a central bore of the lateral isolator that is pressure independent from a mud flow pressure column between an exterior of the lateral isolator and the wellbore.

6. The lateral isolator of claim 5, wherein, when an input force is laterally applied to the inner member in a first direction, the lateral isolator is configured such that a first reaction force opposing the input force is reacted through the first elastomeric package, a second reaction force for opposing the first reaction force is reacted through the second elastomeric package, and a fin force opposing the input force is reacted through at least one of the compliant fins.

7. The lateral isolator of claim 1, wherein the first and second elastomeric packages are pre-compressed in an axial direction.

8. The lateral isolator of claim 1, wherein the first and second elastomeric packages are configured to bulge and bulk load.

9. The lateral isolator of claim 8, wherein the bulk loading is in response to a cocking movement of the inner member about the pivot ring towards the inclined position, and wherein the bulk loading provides a soft snub rather than a direct contact.

10. The lateral isolator of claim 1, wherein the pivot ring comprises a polygonal profile complimentary to a polygonal profile provided within the housing, and wherein the polygonal profiles of the pivot ring and the housing are configured to provide torsional locking between the inner member and the housing.

11. The lateral isolator of claim 10, wherein the elastomeric packages are configured such that the inner member is rotatably displaceable relative to the housing.

12. The lateral isolator of claim 1, wherein:

the first elastomeric package is configured to exert, when the inner member is not in the non-deflected state, an upstream reaction force on the inner member;

the second elastomeric package is configured to exert, when the inner member is not in the non-deflected state, a downstream reaction force on the inner member; and the upstream reaction force and the downstream reaction force are in a direction of movement of the inner member towards the non-deflected state.

13. A lateral isolator comprising:

a housing comprising an upstream end and a downstream end;

an inner member comprising a pivot ring disposed within the housing;

a first elastomeric package disposed between the housing and the inner member, at a position longitudinally between the pivot ring and the upstream end;

a second elastomeric package disposed between the housing and the inner member, at a position longitudinally between the pivot ring and the downstream end; and a centralizer sub attached at the upstream end of the housing, the centralizer sub comprising a plurality of compliant fins attached to an outer surface of the centralizer sub and being spaced radially apart from each other about a longitudinal central axis of the lateral isolator.

14. The lateral isolator of claim 13, wherein:

the first elastomeric package and the second elastomeric package are configured to collectively respond to a first input force frequency range;

the plurality of compliant fins are configured to collectively respond to a second input force frequency range; and the second input force frequency range is different than first input force frequency range; or wherein each of the compliant fins is configured such that, when a first compliant fin of the compliant fins is radially compressed, an area of an outer face of the compliant fin, which is in contact with a structure in which the lateral isolator is positioned increases to provide a nonlinear stiffening force to the lateral isolator.

15. The lateral isolator of claim 13, wherein, when the lateral isolator is disposed in a wellbore, the lateral isolator maintains a lateral isolator pressure column through a central bore of the lateral isolator that is pressure independent from a mud flow pressure column between an exterior of the lateral isolator and the wellbore.

16. The lateral isolator of claim 15, wherein, when an input force is laterally applied to the inner member in a first direction, the lateral isolator is configured such that a first reaction force opposing the input force is reacted through the first elastomeric package, a second reaction force for opposing the first reaction force is reacted through the second elastomeric package, and a fin force opposing the input force is reacted through at least one of the compliant fins.

17. The lateral isolator of claim 13, wherein:

the pivot ring comprises a polygonal profile complimentary to a polygonal profile provided within the housing; and the polygonal profiles of the pivot ring and the housing are configured to provide torsional locking between the inner member and the housing.

18. The lateral isolator of claim 17, wherein the elastomeric packages are configured such that the inner member is rotatably displaceable relative to the housing.

19. A lateral isolator comprising:

a housing comprising an upstream end and a downstream end;

an inner member comprising a pivot ring disposed within the housing;

a first elastomeric package disposed between the housing and the inner member, at a position longitudinally between the pivot ring and the upstream end; and a second elastomeric package disposed between the housing and the inner member, at a position longitudinally between the pivot ring and the downstream end;

wherein the pivot ring comprises a polygonal profile complimentary to a polygonal profile provided within the housing; and wherein the polygonal profiles of the pivot ring and the housing are configured to provide torsional locking between the inner member and the housing.

20. The lateral isolator of claim 19, wherein the elastomeric packages are configured such that the inner member is rotatably displaceable relative to the housing.

* * * * *